US007850364B2

(12) United States Patent
Harris et al.

(10) Patent No.: US 7,850,364 B2
(45) Date of Patent: Dec. 14, 2010

(54) CONCRETE BATCH PLANT WITH POLYMERIC MIXER DRUM

(75) Inventors: Thomas J. Harris, Byron, MN (US); William D. Tippins, Westfield, IN (US); Anthony J. Khouri, 39 Shoalhaven Road, Sylvania Waters, Sydney NSW 2224 (AU); William Rodgers, 10-12 Childs Road, Chipping Norton, Sydney, NSW 2224 (AU)

(73) Assignees: McNeilus Truck and Manufacturing, Inc., Dodge Center, MN (US); Favco Composite Technology (US), Inc., Sydney (AU); Favco Truck Mixers International Pty Limited, Sydney (AU); Composite Technology R&D Pty Limited, Sydney (AU); Anthony J. Khouri, Sydney (AU); William Rodgers, Sydney (AU)

( * ) Notice: Subject to any disclaimer, the term of this patent is extended or adjusted under 35 U.S.C. 154(b) by 146 days.

(21) Appl. No.: 11/596,337

(22) PCT Filed: May 18, 2005

(86) PCT No.: PCT/US2005/017999

§ 371 (c)(1),
(2), (4) Date: Apr. 11, 2008

(87) PCT Pub. No.: WO2005/113211

PCT Pub. Date: Dec. 1, 2005

(65) Prior Publication Data

US 2008/0259715 A1 Oct. 23, 2008

Related U.S. Application Data

(60) Provisional application No. 60/572,232, filed on May 18, 2004.

(51) Int. Cl.
*B28C 5/20* (2006.01)
*B28C 7/16* (2006.01)

(52) U.S. Cl. ..... 366/18; 366/26; 366/44; 366/45; 366/59; 366/60

(58) Field of Classification Search ..... 366/6, 366/8, 14, 18, 26, 44–46, 53–63
See application file for complete search history.

(56) References Cited

U.S. PATENT DOCUMENTS 1,501,566 A 7/1924 Lundberg (Continued)

FOREIGN PATENT DOCUMENTS

CN 1132486 A 10/1996

(Continued)

OTHER PUBLICATIONS

International Search Report for PCT/US05/17999, date of mailing Oct. 19, 2005, 2 pages.

(Continued)

*Primary Examiner*—Charles E Cooley
(74) *Attorney, Agent, or Firm*—Foley & Lardner LLP

(57) ABSTRACT

A concrete batch plant is disclosed including a frame and a transit mixer drum having an open end and a closed end. The drum is configured to be utilized both with the concrete batch plant and on a transit mixer truck. The drum may be pivotally coupled to the frame of the concrete batch plant for movement between a first position in which the open end is positioned to receive cement from a cement supply and to receive aggregate from an aggregate supply and a second position in which the open end is positioned to discharge the mixed cement and aggregate. Further, the drum may be a polymeric drum including an interior surface formed by a plurality of complementary molded helical polymeric sections joined along a helical seam.

22 Claims, 10 Drawing Sheets

U.S. PATENT DOCUMENTS 1,781,965 A 11/1930 Ball
1,983,891 A 12/1934 Ball
1,987,894 A * 1/1935 Eggert ..... 366/63
2,054,469 A * 9/1936 Rybeck ..... 366/45
2,073,652 A * 3/1937 Robb ..... 366/14
2,109,534 A * 3/1938 Johnson ..... 366/18
2,174,089 A * 9/1939 Johnson ..... 366/14
2,199,289 A * 4/1940 Johnson ..... 366/14
2,238,343 A * 4/1941 Rybeck et al. ..... 366/14
2,303,902 A 12/1942 Ball
2,352,202 A * 6/1944 Johnson ..... 366/14
2,408,397 A * 10/1946 Johnson ..... 366/14
2,437,302 A * 3/1948 Maxon, Jr. ..... 222/488
2,511,240 A 6/1950 Bohmer et al.
2,696,372 A 12/1954 Gerst
3,080,152 A 3/1963 Lendved
3,144,242 A 8/1964 Retzlaff
3,165,789 A 1/1965 Jackson
3,317,194 A * 5/1967 Heltzel ..... 366/27
3,549,077 A 12/1970 Huck
3,592,448 A 7/1971 Stevenson
3,641,730 A 2/1972 Meckstroth
3,664,161 A 5/1972 Cressman
3,700,512 A 10/1972 Pearson et al.
3,717,328 A 2/1973 Stevenson
3,717,916 A 2/1973 Wienand et al.
3,795,121 A 3/1974 Cressman
3,795,364 A 3/1974 Kattner
3,830,899 A 8/1974 Piccioli et al.
3,888,468 A * 6/1975 Albin ..... 366/45
3,929,321 A 12/1975 Sims
4,064,956 A 12/1977 Wildey
4,086,378 A 4/1978 Kam et al.
4,124,304 A 11/1978 Suganuma
4,137,950 A 2/1979 Briscall
4,223,997 A 9/1980 Violet et al.
4,309,511 A 1/1982 Jefferson et al.
4,363,687 A 12/1982 Anderson
4,366,919 A 1/1983 Anderson
4,391,108 A 7/1983 Albers
4,435,082 A 3/1984 Bishop
4,491,415 A 1/1985 Bishop
4,521,116 A * 6/1985 Adsit ..... 366/54
4,525,228 A 6/1985 Bowen
4,569,648 A 2/1986 Riederer et al.
4,585,356 A 4/1986 Hudelmaier
4,634,284 A 1/1987 Bishop
4,655,602 A 4/1987 Tomlinson
4,690,306 A 9/1987 Staheli
4,690,988 A 9/1987 Hoffman et al.
4,730,934 A 3/1988 Schwing
4,750,840 A 6/1988 Bishop
4,756,623 A 7/1988 Bishop
4,792,234 A * 12/1988 Doherty ..... 366/14
4,822,272 A 4/1989 Yanase et al.
4,877,327 A 10/1989 Whiteman, Jr.
4,937,010 A 6/1990 Maillat
5,056,924 A 10/1991 Christenson
5,118,198 A 6/1992 Whiteman, Jr.
5,178,457 A 1/1993 Helmy
RE34,505 E 1/1994 Whiteman, Jr.
5,302,017 A 4/1994 Platek et al.
5,326,795 A 7/1994 Wykowski
5,348,387 A 9/1994 Gordon et al.
5,378,061 A 1/1995 Christenson
5,383,581 A 1/1995 LeMarbe et al.
5,388,767 A 2/1995 Moses
5,388,768 A 2/1995 Moses
5,399,192 A 3/1995 Yamasoe
5,411,329 A * 5/1995 Perry ..... 366/26
5,427,449 A 6/1995 Christenson et al.
5,429,308 A 7/1995 Brown
5,432,211 A 7/1995 Morita et al.
5,441,341 A 8/1995 Halsted
5,460,675 A 10/1995 Moser
5,474,379 A * 12/1995 Perry ..... 366/26
5,487,604 A 1/1996 Moran
5,492,401 A 2/1996 Halsted
5,570,822 A 11/1996 LeMarbe et al.
5,667,298 A * 9/1997 Musil et al. ..... 366/18
5,683,177 A 11/1997 Hoferichter et al.
5,739,240 A 4/1998 Smith
5,772,938 A 6/1998 Sharp
5,773,531 A 6/1998 Smith
5,816,702 A 10/1998 Mays et al.
5,839,924 A 11/1998 Ritson
5,908,913 A 6/1999 Orthmann et al.
5,979,794 A 11/1999 DeFillipi et al.
6,021,961 A 2/2000 Brown
H1872 H 10/2000 Bowman
6,277,939 B1 8/2001 Smith
6,329,475 B1 12/2001 Kelly
6,388,023 B1 5/2002 Hsu et al.
6,472,069 B1 10/2002 Bailey et al.
6,500,911 B1 12/2002 Endo et al.
6,527,203 B2 3/2003 Hurray et al.
6,583,218 B1 6/2003 Airola et al.
6,617,417 B1 9/2003 Airola et al.
6,660,373 B2 12/2003 Hsu et al.
6,663,021 B1 12/2003 Scarpa et al.
6,705,538 B2 3/2004 Fecht et al.
6,800,170 B2 10/2004 Kendall et al.
6,815,499 B2 11/2004 Yasumura et al.
6,830,804 B2 12/2004 Hsu et al.
6,872,337 B2 3/2005 Mellentine et al.
6,902,311 B1 * 6/2005 Khouri et al. ..... 366/54
6,938,799 B1 9/2005 Berntsen et al.
6,951,909 B2 10/2005 Deviny et al.
7,744,267 B2 * 6/2010 Daly et al. ..... 366/54
2002/0022695 A1 2/2002 Ueno et al.
2002/0071336 A1 6/2002 Smith et al.
2002/0072574 A1 6/2002 Hsu et al.
2003/0105177 A1 6/2003 Parfondry et al.
2005/0103431 A1 * 5/2005 Khouri et al. ..... 156/173
2006/0152997 A1 * 7/2006 Khouri et al. ..... 366/59
2006/0167140 A1 7/2006 Altounian et al.
2007/0159915 A1 * 7/2007 Daly et al. ..... 366/54
2007/0187434 A1 8/2007 Schrafel
2007/0189110 A1 * 8/2007 Khouri ..... 366/59
2008/0225632 A1 * 9/2008 Khouri ..... 366/59
2008/0259715 A1 * 10/2008 Harris et al. ..... 366/18
2008/0259716 A1 * 10/2008 Khouri ..... 366/57
2008/0279035 A1 * 11/2008 Altounian ..... 366/1
2008/0291771 A1 * 11/2008 Khouri et al. ..... 366/59

FOREIGN PATENT DOCUMENTS

DE 956 378 C 1/1957
DE 8501010 U1 10/1985
DE 88 01 881.4 U1 4/1988
DE 40 10 539 A1 10/1991
EP 0438852 B1 1/1996
EP 0696422 B1 6/1999
EP 0 998 33 B1 5/2000
EP 1238904 A2 9/2002
GB 2 032 793 A 5/1980
GB 2032793 A 5/1980
GB 2 274 404 A 7/1994
IL 148560 6/2007
JP 53-88261 8/1978
JP 8-114096 A 5/1996
JP 8-199052 A 8/1996
JP 11-134001 A 5/1999
JP 2001-79418 A 3/2001

| | | | |
|---|---|---|---|
| RU | 1796533 | A1 | 2/1993 |
| RU | 2 052 350 | C1 | 1/1996 |
| SU | 421520 | | 3/1974 |
| SU | 977188 | A1 | 11/1982 |
| WO | WO 97/32702 | | 9/1997 |
| WO | WO 00/64651 | A1 | 11/2000 |
| WO | WO 01/26871 | A1 | 4/2001 |
| WO | WO 03/010169 | A1 | 12/2003 |
| WO | WO 03/101694 | A1 | 12/2003 |
| WO | WO 2005/018894 | A1 | 3/2005 |
| WO | WO 2005/018895 | A1 | 3/2005 |
| WO | WO 2005/018897 | A1 | 3/2005 |
| WO | WO 2005/018898 | A1 | 3/2005 |
| WO | WO 2005/018899 | A1 | 3/2005 |
| WO | WO 2005/025438 | A1 | 3/2005 |
| WO | WO 2005/025657 | A1 | 3/2005 |
| WO | WO 2005/095073 | A1 | 10/2005 |
| WO | WO 2005/113211 | A1 | 12/2005 |
| WO | WO 2006/005205 | A1 | 1/2006 |
| WO | WO 2006069285 | A2 * | 6/2006 |
| WO | WO 2007/061736 | A2 | 5/2007 |
| WO | WO 2007/094930 | A1 | 8/2007 |

OTHER PUBLICATIONS

Supplementary European Search Report relating to International Application No. EP 04 77 7337, date of completion of the search, Nov. 27, 2008 (2 pgs.).

Supplementary European Search Report relating to International Application No. EP 03 81 8345, date of completion of the search Nov. 26, 2008 (2 pgs.).

Supplementary European Search Report relating to International Application No. EP 03 81 8344, date of completion of the search Nov. 26, 2008 (2 pgs.).

Supplementary European Search Report relating to International Application No. EP 03 81 8335, date of completion of the search, Nov. 26, 2008 (2 pgs.).

Supplementary European Search Report relating to International Application No. EP 03 72 4639, date of completionof the search Dec. 21, 2007 (2 pgs.).

* cited by examiner

CONCRETE BATCH PLANT WITH POLYMERIC MIXER DRUM

BACKGROUND

Concrete batch plants are used in the preparation of concrete. Such plants may be portable in nature or stationary in nature. Such plants typically include a supply of cement and a supply of aggregate. Concrete batch plants may also include a supply of liquid such as water. Dry batch plants pre-measure the dry ingredients of concrete, such as cement and aggregate, and load the dry ingredients into a transit mixer drum located on a mixer truck. Liquid, such as water, is also supplied into the transit mixer drum of the transit mixer truck. The transit mixer truck is rotatably driven to mix the contents to form concrete.

Wet batch plants additionally include a tilt mixer drum. The tilt mixer drum is typically a very large steel drum having linear internal blades. Wet batch plants load dry concrete ingredients and liquid into the transit mixer drum which is rotated to mix the ingredients and to form concrete. The drum is then tilted to unload the mixed concrete into a transit mixer drum of a transit mixer truck. Although commonly used, such concrete batch plants have several disadvantages. Dry batch plants result in the creation of dust. Although wet batch plants eliminate the issues relating to dust, wet batch plants are extremely cumbersome, heavy, expensive to build, expensive to maintain and repair and expensive to clean. There remains a need for an inexpensive wet batch plant 1 that is lighter in weight, that is easily cleaned and that can be quickly and easily unloaded.

DETAILED DESCRIPTION OF EXAMPLE EMBODIMENTS

Figure 1:
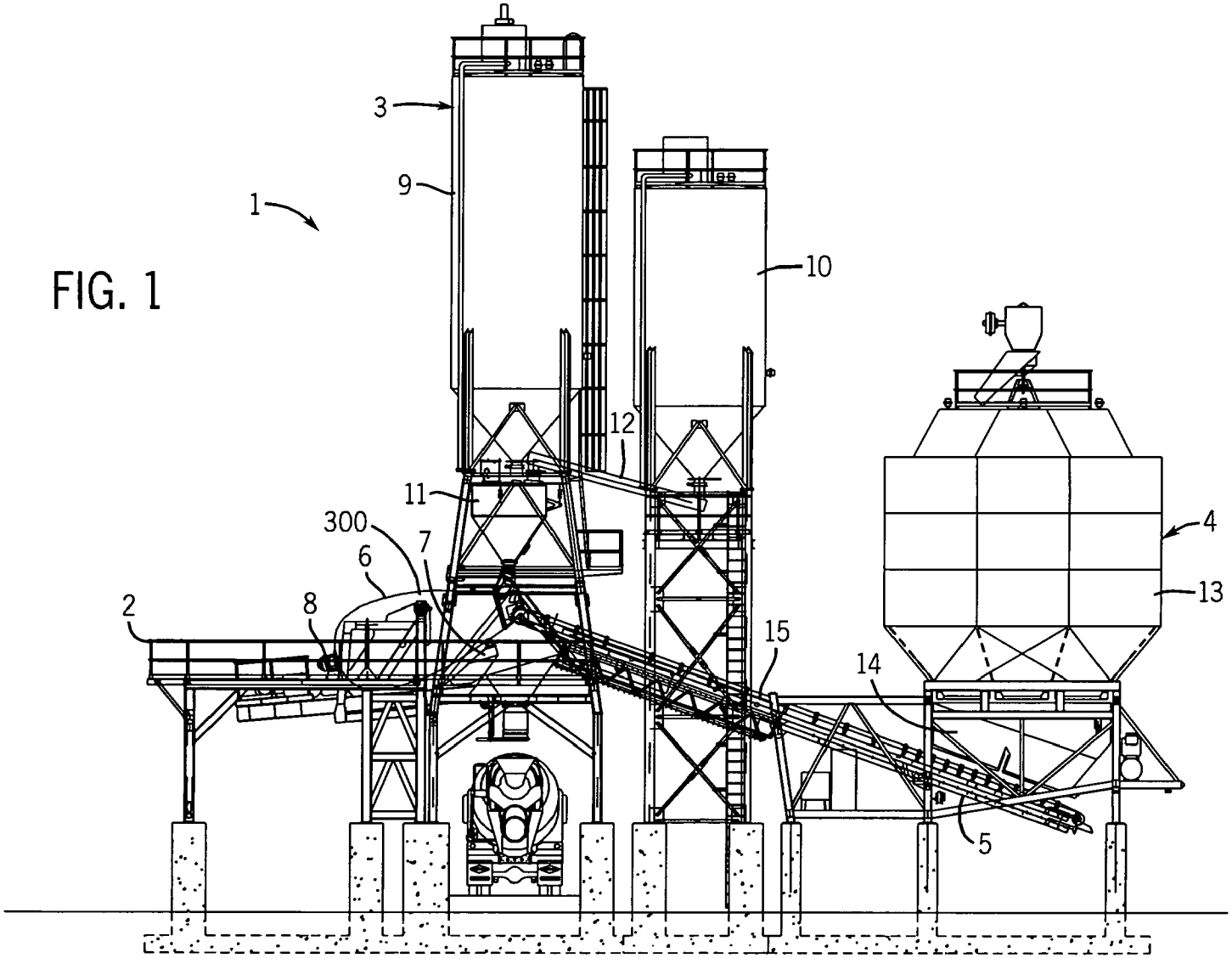
FIG. 1 is a side elevational view of a concrete batch plant according to one example embodiment.

FIG. 1 is a side elevational view of a concrete batch according to one embodiment of the present invention. Concrete batch plant 1 generally includes frame 2, cement supply 3, aggregate supply 4, liquid supply 5, transit mixer drum 6, tilt actuator 7 and drum drive 8. Cement supply 3 generally comprises one or more mechanisms and storage structures configured to supply cement to transit mixer 20. In the particular embodiment shown, cement supply 3 includes main silo 9, auxiliary silo 10 and cement apportioning device 11. Silo 9 is supported by frame 2 and is configured to contain and store a supply of cement. Silo is located above apportioning device 11 such that cement from silo 9 may be delivered to apportioning device 11 using gravity. Auxiliary silo 10 comprises an auxiliary source of cement or an additional source for a distinct type or kind of cement. Silo 10 includes a transport system 12 configured to deliver cement or other material from auxiliary silo 10 to apportioning device 11.

Apportioning device 11 generally comprises a device configured to apportion or measure out defined quantities of cement or other materials from silo 9 and/or silo 10. In the embodiment illustrated, apportioning device 11 comprises a cement batcher configured to weigh a quantity of cement or other material from silo 9 and/or silo 10 prior to the apportioned quantity of material from silos 9 and/or 10 from being allowed to travel under the force of gravity or by other means into transit mixer drum 6.

Aggregate supply 4 comprises one or more mechanisms and storage structures configured to supply one or more types of aggregate to transit mixer drum 6. In the particular embodiment illustrated, aggregate supply 4 includes bin 13, apportioning device 14 and transport mechanism 15. Bin 13 comprises a storage structure configured to contain one or more aggregate. In the particular embodiment illustrated, bin 13 is configured to contain four distinct aggregate types. Bin 13 is generally located above apportioning device 14 such that aggregate from bin 13 may be delivered to apportioning device 14.

Apportioning device 14 comprises a device configured to apportion or measure out predefined quantities of one or more aggregate for supply to transit mixer drum 6. In the particular embodiments illustrated, apportioning device 14 comprises an aggregate batcher configured to weigh out quantities of aggregate. In other embodiments, other devices or means may be used to measure out quantities, such as volume, of aggregate from bin 13. Apportioning device 14 is supported by frame 2 above transport mechanism 15 such that aggregate may be delivered using gravity to transport mechanism 15.

Transport mechanism 15 generally comprises a device configured to transport and deliver aggregate from bin 13 to transit mixer drum 6. In the particular embodiment illustrated, transport mechanism 15 comprises a conveyor. In other embodiments, aggregate bin 13 may alternatively be located above transit mixer 6 while silo 9 and silo 10 utilize transport mechanism 15 for delivering material to drum 6. In still other embodiments, cement supply 3 and aggregate supply 4 may alternatively have other configurations. For example, in other embodiments, both cement supply 3 and aggregate supply 4 may share a common transport mechanism 15 for delivering materials to drum 6. In still other embodiments, cement supply 3 may omit silos 9 and 10 or aggregate supply 4 may omit bin 13, wherein materials are simply unloaded from a vehicle or other source into apportioning devices 30 and 38. In still another embodiment, a single apportioning device may be utilized to measure both aggregate and cement being supplied to transport mechanism 15 for delivery to drum 6. In still yet other embodiments, cement supply 3 and aggregate supply 4 may merely comprise transport mechanism 15 configured to transport and deliver cement and aggregate supplied to it to transport drum 6.

Liquid supply 5 generally comprises one or more mechanisms configured to supply liquid, such as water, to drum 6. In the particular embodiment illustrated, liquid supply 5 comprises a fluid meter and a series of fluid conduits such as piping or tubing, which connect the flow of fluid to drum 6.

Figure 3:
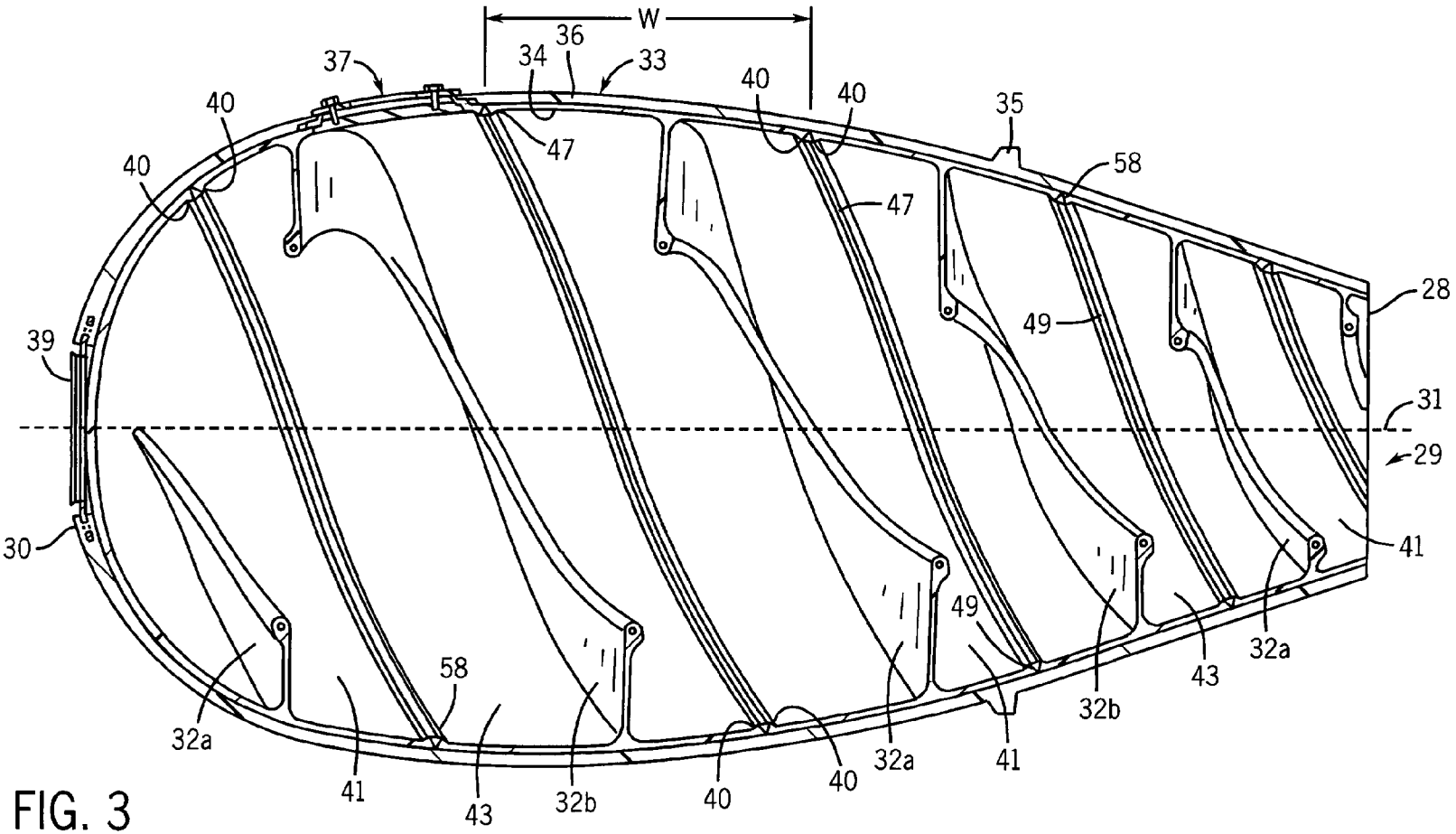
FIG. 3 is a sectional view of the drum of FIG. 2 taken along line 3-3 according to an example embodiment.

Transit mixer drum 6 comprises a drum configured for normal use upon a rear discharge transit mixer truck. As shown by FIG. 3, mixing drum 6 includes a barrel 33, projections 32, ramps 40, a hatch cover assembly 37 or 200 (shown in FIG. 10), a drive ring 39, and a roller ring 35. Barrel 33 is a generally teardrop- or pear-shaped container that has an opening 28 on one end 29 (the smaller end) and a drive ring 39 (described below) coupled to the other larger end 30 of barrel 33. Barrel 33 includes an inner drum layer 34 and an outer drum layer 36. Inner drum layer 34 is made up of two spiral-shaped sections 41 and 43 that are "screwed" or mated together. Each of sections 41 and 43 is a substantially flat panel that is formed in the shape of a spiral around an axis that becomes a central axis 31 of barrel 33 when sections 41 and 43 are completely assembled. Each of sections 41 and 43 has a width W that extends substantially parallel to axis 31 of barrel 33 (or that extends generally along the length of the central axis) and a length that substantially circumscribes or encircles the axis 31. According to one exemplary embodiment, the width of each section varies along the length of each section, for example from between approximately 6 inches and 36 inches. Each of the sections 41 and 43 has a first edge 47 that extends the length of the section and a second edge 49 that extends the length of the section. Each of sections 41 and 43 is spiraled around the axis 31 of barrel 33 such that there is a gap between the first edge 47 of the section and the second edge 49 of the same section. This gap provides the space that will be filled by the other section when it is mated or screwed to the first section. Accordingly, when the sections 41 and 43 are assembled together to form inner drum layer 34, edge 47 of section 41 will abut edge 49 of section 43 and edge 49 of section 41 will abut edge 47 of section 43. A helical seam 58 is formed where the edges of sections 41 and 43 abut one another.

Once the two sections of the inner drum layer 34 have been assembled, outer drum layer 36 is formed as a continuous layer around the outer surface of inner drum layer 34. Accordingly, outer drum layer 34 extends continuously from one end of the barrel to the other and spans the seams between sections 41 and 43. Outer drum layer 36 is a structural layer that is made from a fiber reinforced composite material applied by winding resin coated fibers around the outer surface of inner drum layer 34. According to one embodiment, the resin is Hetron 942, available from Ashland Chemical, in Dublin, Ohio, and the fibers are fiberglass, preferably 2400 Tex E Glass (approximately 206 yards/lb). According to one embodiment, the angle at which the fibers are wound around the drum at the major axis (the location at which barrel 33 has the greatest diameter) is approximately 10.5 degrees relative to axis 31 of the barrel 33. During the winding process, the resin coated fibers are wrapped generally from one end of the drum to the other. According to one embodiment, the fibers are provide in a ribbon or bundle that is approximately 250 millimeter wide and includes 64 strands. The ribbon of fibers is wrapped around the drum such that there is an approximately 50% overlap between each pass of the ribbon. The wrapping the fibers from end to end, helps to provide drum 6 with the structural support to withstand the various forces that are applied to drum 6 in a variety of different directions.

According to an exemplary embodiment, projections 32 and ramps 40 are integrally formed a single unitary body with sections 41 and 43. Each of sections 41 and 43, and the corresponding projections and ramps, are formed through an injection molding process from polyurethane, and outer drum layer 36 is made using fiberglass fibers coated with a resin. According to other alternative embodiments, the inner drum layer and/or the outer drum layer may be made from any one or more of a variety of different materials including but not limited to polymers, elastomers, rubbers, ceramics, metals, composites, etc. According to still other alternative embodiments, other processes or components may be used to construct the drum. For example, according to various alternative embodiments, the inner drum layer may be formed as a single unitary body, or from any number of separate pieces, components, or sections. According to other alternative embodiments, the inner drum layer, or any of sections making up part of the inner drum layer, may be made using other methods or techniques. According to still other alternative embodiments, the outer drum layer may be applied over the inner drum layer using any one or more of a number of different methods or techniques.

Referring still to FIG. 3, projections 32*a* and 32*b* are coupled to sections 41 and 43, respectively, and extend inwardly toward central axis 31 of barrel 33 and along the length of the respective section. Accordingly, two substantially identical projections 32*a* and 32*b* are coupled to inner drum layer 34 and spiral around the inner surface of inner drum layer 34 in the shape of an archimedean spiral. In one embodiment, projection 32*a* and 32*b* extend from an axial end of barrel 33 across an anal midpoint of barrel 33. Projections 32*a* and 32*b* are circumferentially spaced apart around axis 31 by approximately 180 degrees. Because projections 32*a* and 32*b* are substantially identical, further references to the projections will simply refer to "projection 32" when discussing either (or both of) projection 32*a* or 32*b*.

Figures 4, 5, 6, 7:
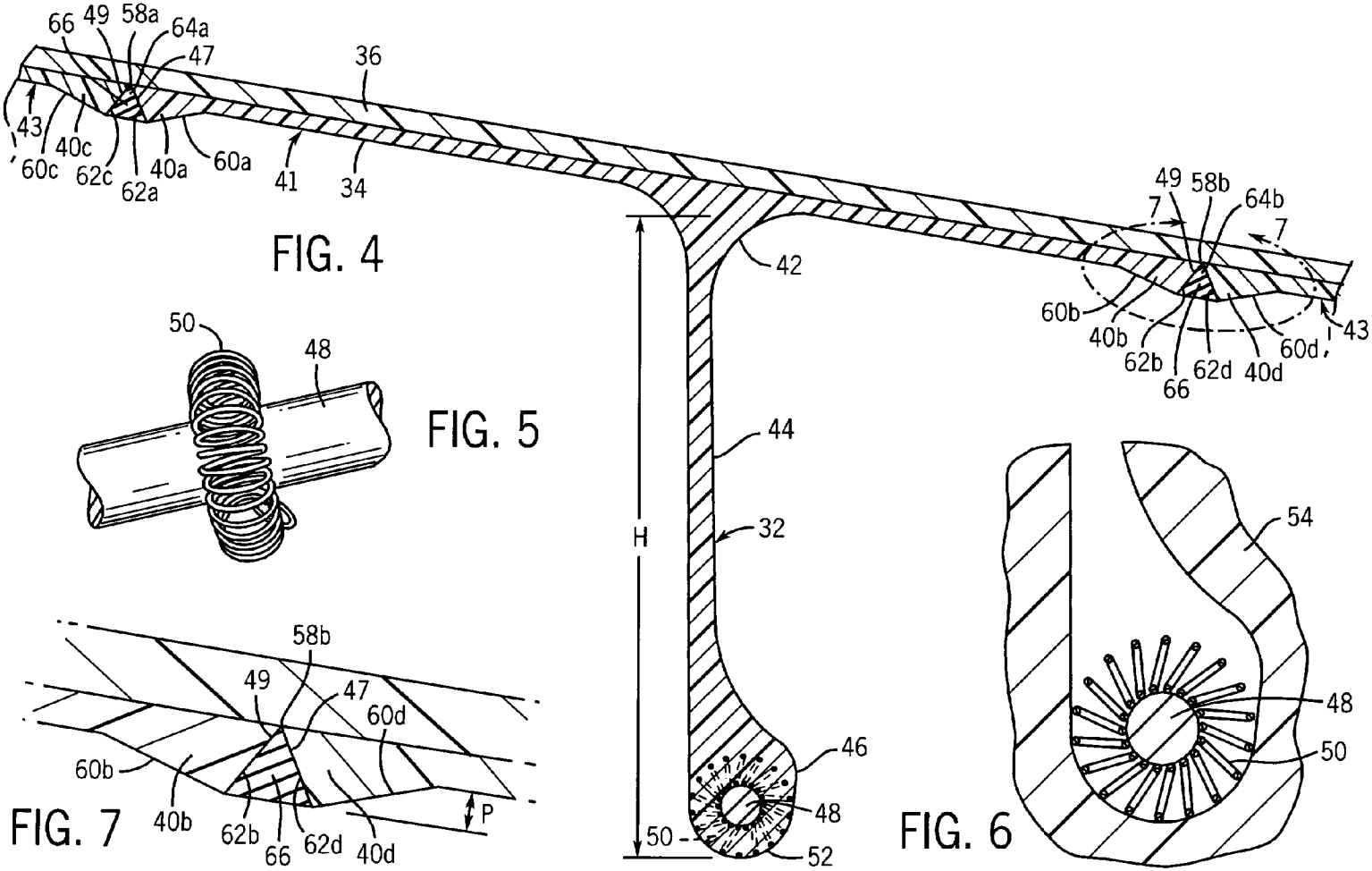
FIG. 4 is an enlarged fragmentary view of the drum of FIG. 3 according to an example embodiment.
FIG. 5 is a fragmentary perspective view of a portion of a support member of the projection of the drum of FIG. 2 according to an example embodiment.
FIG. 6 is a sectional view illustrating the formation of the projection about the support member according to an example embodiment.
FIG. 7 is an enlarged fragmentary view of the portion of the drum of FIG. 4 taken along line 7-7 according to an example embodiment.

A projection and one or more ramps are coupled to each section of inner drum layer 34. Because the projection and ramp(s) that are coupled to each section include substantially identical features and elements, where appropriate, the projection and ramps that are coupled to one section will be described, it being understood that the projection and ramps of the other section are substantially identical. FIG. 4 illustrates projection 32 and ramps 40*a* and 40*b*, which are coupled to section 41, in greater detail.

Projection 32 (e.g., fin, blade, vane, screw, formation, etc.) includes a base portion 42, an intermediate portion 44, and an end portion 46. Base portion 42 extends inwardly from section 41 toward the axis of drum 6 and serves as a transitional area between section 41 and intermediate portion 44 of projection 32. Such a transitional area is beneficial in that it tends to reduce stress concentrations in base portion 42 that may result from the application of force to projections 32 by the concrete. The reduction of the stress concentrations tends to reduce the likelihood that projection 32 will fail due to fatigue. To provide the transitional area, base portion 42 is radiused or tapered on each side of projection 32 to provide a gradual transition from section 41 to intermediate portion 44. To minimize any unwanted accumulation of set concrete, the radius is preferably greater than 10 millimeters. According to one exemplary embodiment, the radius is approximately 50 millimeters. According to another embodiment, the radius begins on each side of projection 32 proximate section 41 approximately three inches from the centerline of projection 32 and ends approximately five inches up the height H of projection 32, proximate intermediate region 44 of projection 32. Because drum 6 rotates, the orientation of any particular section of projection 32 constantly changes. Accordingly, to simplify the description of projection 32, the term "height," when used in reference to projection 32, will refer to the distance projection 32 extends inwardly toward the center axis of drum 6, measured from the center of base portion proximate section 41 to the tip of end portion 46. It should be noted, however, that the height of projection 32 changes along the length of projection 32. Consequently, the locations at which the radius or taper begins and/or ends, or the distance over which the radius or taper extends, may vary depending on the height and/or location of any particular portion of the projection. According to various alternative embodiments, the radius of the base region may be constant or it may vary. According to other alternative embodiments, the transition between the section and the intermediate portion of the projection may be beveled or may take the form of some other gradual transition. Moreover, the locations at which the transition or taper may begin or end may vary depending on the material used, the thickness of the inner drum wall, the height of the projection, the loads that will be placed on the projection, the location of a particular portion of the projection within the drum, and a variety of other factors.

According to any exemplary embodiment, the characteristics of the taper should be such that the projection is allowed to at least partially flex under the loads applied by the concrete. However, if the taper is such that it allows the projection to flex too much, the projection may quickly fatigue. One the other hand, if the taper is such that it does not allow the projection to flex enough, the force of the concrete on the projection may pry on inner drum layer 34 and potentially tear inner drum layer away from outer drum layer 36.

Intermediate portion 44 of projection 32 extends between base portion 42 and end portion 46. According to one embodiment, intermediate portion 44 has a thickness of approximately six millimeters and is designed to flex when force from the concrete is applied thereto.

End portion 46 of projection 32 extends from intermediate portion 44 toward the axis of drum 6 and includes a support member 48 and spacers 50. The thickness of end portion 46 is generally greater than the thickness of intermediate portion 44. Depending on where along the length of projection 32 a particular section of end portion 46 is provided, the added thickness of end portion 46 may be centered over intermediate portion 44 or offset to one side or the other. In some areas along the length of projection 32, end portion 46 is provided on only one side of intermediate portion 44 (e.g., the side closest to opening 28 or the side closest to end 30). In such a configuration, end portion 46 acts as a lip or flange that extends over one side of intermediate portion 44 and serves to improve the ability of projection 32 to move or mix concrete that comes into contact with the side of intermediate portion 44 over which end portion 46 extends. Due to the increased thickness of end portion 46 in relation to intermediate portion 44, end portion 46 includes a transitional region 45 that provides a gradual transition from intermediate portion 44 to end portion 46. According to an exemplary embodiment, the transitional region is radiused. According to alternative embodiments, the transitional region may be beveled or tapered. To minimize any wear or accumulation that may occur as a result of concrete passing over end portion 46, projection 32 terminates in a rounded edge 52.

According to various alternative embodiments, each of the base region, the intermediate region, and the end region may be different sizes, shapes, thicknesses, lengths, etc. depending on the particular situation or circumstances in which the drum will be used.

FIGS. 4-6 illustrate support member 48 in greater detail. As shown in FIGS. 4-6, support member or torsion bar 48 is an elongated circular rod or beam that is embedded within end portion 46 of projection 32 to provide structural support to projection 32. Torsion bar 48 has a shape that corresponds to the spiral-like shape of projection 32 and extends the entire length of projection 32. The ends of bar 48 have flared fibers that are embedded in inner drum layer 34. Torsion bar 48 serves to substantially restrict the ability of end portion 46 of projection 32 to flex when a load is applied to projection 32 by the concrete, and thereby prevents projection 32 from essentially being folded or bent over by the concrete. Although sufficiently rigid to support projection 32, torsion bar 48 is preferably torsionally flexible. The torsional flexibility of torsion bar 48 allows it to withstand torsional loads that result from some deflection of end portion 46 of projection 32. According to one exemplary embodiment, support member 48 is a composite material that is made primarily of carbon or graphite fibers and a urethane-based resin. According to one exemplary embodiment, the ratio of carbon fibers to the urethane-base resin is 11 pounds of carbon fiber to 9 pounds of urethane-based resin. One example of such a urethane-based resin is Erapol EXP 02-320, available from Era Polymers Pty Ltd in Australia. According to alternative embodiments, the support member may be made from any combination of materials that allows the support member to provide the desired structural support yet at the same time allows the torsion bar to withstand the torsional loads that may be applied to the torsion bar. For example, the torsion bar may be made from one or more of fiberglass fibers and ester-based resins. According to other alternative embodiments, the size and shape of the of the support member may vary depending on the particular circumstances in which the support member will be used.

According to an exemplary embodiment, support member 48 is made through a pulltrusion process. The pulltrustion process includes the steps of collecting a bundle of fibers, passing the fibers through a bath of resin, and then pulling the resin coated fibers through a tube. The support member 48 is then wrapped around an appropriately shaped mandrel and allowed to cure to give support member 48 the desired shape. The fibers are pulled through the tube by a cable of a winch that is passed through the tube and coupled to the fibers. To facilitate the coupling of the cable to the fibers, the fibers are doubled over and the cable is attached to the loop created by the doubled over fibers. The winch pulls the cable back through the tube, which, in turn, pulls the fibers through the tube. According to one exemplary embodiment, the urethane-based resin through which the fibers are passed before entering the tube is injected into the tube at various points along the length of the tube as the fibers are being pulled through the tube. According to alternative embodiments, the support member may be made by any one or more of a variety of different processes.

According to one exemplary embodiment, projection 32 and ramps 40 are integrally formed with each of sections 41 and 43 as a single unitary body and are made along with sections 41 and 43. As described above, each of sections 41 and 43, and the corresponding projection 32 and ramps 40, are preferably made through an injection molding process during which an elastomer is injected between molds. In order to embed support member 48 within end portion 46 of projection 32, support member 48 is placed in a mold 54 (a portion of which is shown in FIG. 6) that defines the shape of projection 32 prior to the injection of the elastomer. To keep support member 48 in the proper location within the mold during the injection process, spacers, shown as helical springs 50, are wrapped around the circumference of support member 48 and spaced intermittently along the length of support member 48. Each spring 50 is retained around the circumference of support member 48 by connecting one end of spring 50 to the other. When support member 48 and springs 50 are placed in the mold prior to the injection process, springs 50 contact an inside surface of mold 54 and thereby retain support member 48 in the proper location within mold 54.

When the elastomer is injected into the molds, the elastomer flows through spring 50 and surrounds (e.g., embodies, encapsulates, etc.) each of its coils. As a result, there is a continuous flow of the elastomer through spring 50, such that if the elastomer does not securely bond to the coils of spring 50, the areas along projection 32 where springs 50 are placed are not significantly weaker than the areas along projection 32 where there are no spring spacers 50. According to various alternative embodiments, other materials and structures may be used as spacers. For example, the spacer may be made from any one or more of a variety of materials including polymers, elastomers, metals, ceramics, wood, etc. The spacer may also be any one of a variety of different shapes and configurations, including but not limited to, circular, rectangular, triangular, or any other shape. Moreover, the spacer may not substantially surround the support member, but rather may include one or more members that are provided intermittently around the periphery of the support member. According to other alternative embodiments, the spacer may be a flat disc or a cylinder having an outside diameter that contacts the inside surface of the mold and an aperture through which the support member passes. The flat disc or cylinder also may include a plurality of apertures extending therethrough to allow for the continuous flow of the injected elastomer through at least some areas of the disc.

FIGS. 4 and 7 illustrate ramps 40 in more detail. As shown in FIGS. 4 and 7, ramps 40*a*, 40*b*, 40*c*, and 40*d* are raised, ramp-like structures that extend inwardly from section 41 toward center axis 31 of barrel 33. Ramp 40*a* includes a surface 60*a* that extends toward center axis 31 as it approaches helical seam 58*a*, which is formed where edge 47 of section 41 abuts edge 49 of section 43. Ramp 40*a* also includes a surface 62*a* that extends from the end of surface 60*a* back toward section 41 and that terminates at helical seam 58*a*. Ramps 40*b*, 40*c*, and 40*d* include similar surfaces (which are labeled with the same reference numbers as ramp 40*a* followed by the respective letter designation corresponding to each ramp). Preferably, the ramps are provided in pairs, with one ramp on each side of a seam such that the seam is located within a channel or valley that is created by the ramps. Thus, ramp 40*a* cooperates with ramp 40*c* to provide a valley or channel 64*a* that is defined by surface 62*a* of ramp 40*a* and surface 62*c* of ramp 40*c*. Helical seam 58*a* lies at the base of channel 64*a*. Similarly, ramp 40*b* cooperates with ramp 40*d* to provide a valley or channel 64*b* that is defined by surface 62*b* of ramp 40*b* and surface 62*d* of ramp 40*d*. Helical seam 58*b* lies at the base of channel 64*b*. According to an exemplary embodiment, the peak of each ramp extends inwardly from section 41 toward the axis of the drum a distance P, which is approximately six millimeters.

According to various alternative and exemplary embodiments, the proportions and dimensions of the ramps may vary. For example, the distance of corresponding ramps from one another, the angle at which the ramp surfaces extend away from or toward the center axis of the barrel, the location along the wall of the barrel at which the ramp begins to extend toward the center axis of the barrel, the height of the peak of the ramps, etc. may all be varied to suit any particular application. According to another alternative embodiment, only one ramp may be provided proximate each seam.

To facilitate the assembly of sections 41 and 43, sections 41 and 43 of inner drum layer 34 are substantially free of any structures that would help to align sections 41 and 43 with one another. While such structures would help align sections 41 and 43 and possibly reduce any seams that may be provided in inner drum layer 34, such structures may tend to complicate the assembly of sections 41 and 43. In the absence of such alignment structures, sections 41 and 43 are assembled such that one section simply abuts the other section. While allowing the sections to abut one another tends to facilitate the assembly of sections 41 and 43, the absence of any alignment structures on sections 41 and 43 may mean that the edges of sections 41 and 43 may not always be perfectly aligned with one another. As a result, inner drum layer 34 may include helical seams 58*a* and 58*b*. In the absence of ramps 40*a*, 40*b*, 40*c*, and 40*d*, helical seams 58*a* and 58*b* may tend to create high wear points due to the aggregate that would build up in and around the seam. Ramps 40*a*, 40*b*, 40*c*, and 40*d* help to minimize this wear by directing the concrete away from helical seams 58*a* and 58*b*. To further minimize any wear that may occur in the area around helical seams 58*a* and 58*b*, each of channels 64*a* and 64*b* is filled with a filler material 66. When channels 64*a* and 64*b* are filled with filler material 66, the concrete within drum 6 passes over the ramps 40*a*, 40*b*, 40*c*, and 40*d* and over the filler material. Accordingly, any wear that may occur proximate the helical seams 58*a* and 58*b* is reduced. According to an exemplary embodiment, the filler material is the same general material from which the inner drum layer is made. According to various alternative embodiments, the filler material may be any one or more of a variety of different materials, including but not limited to polymers, elastomers, silicones, etc.

Figure 8:
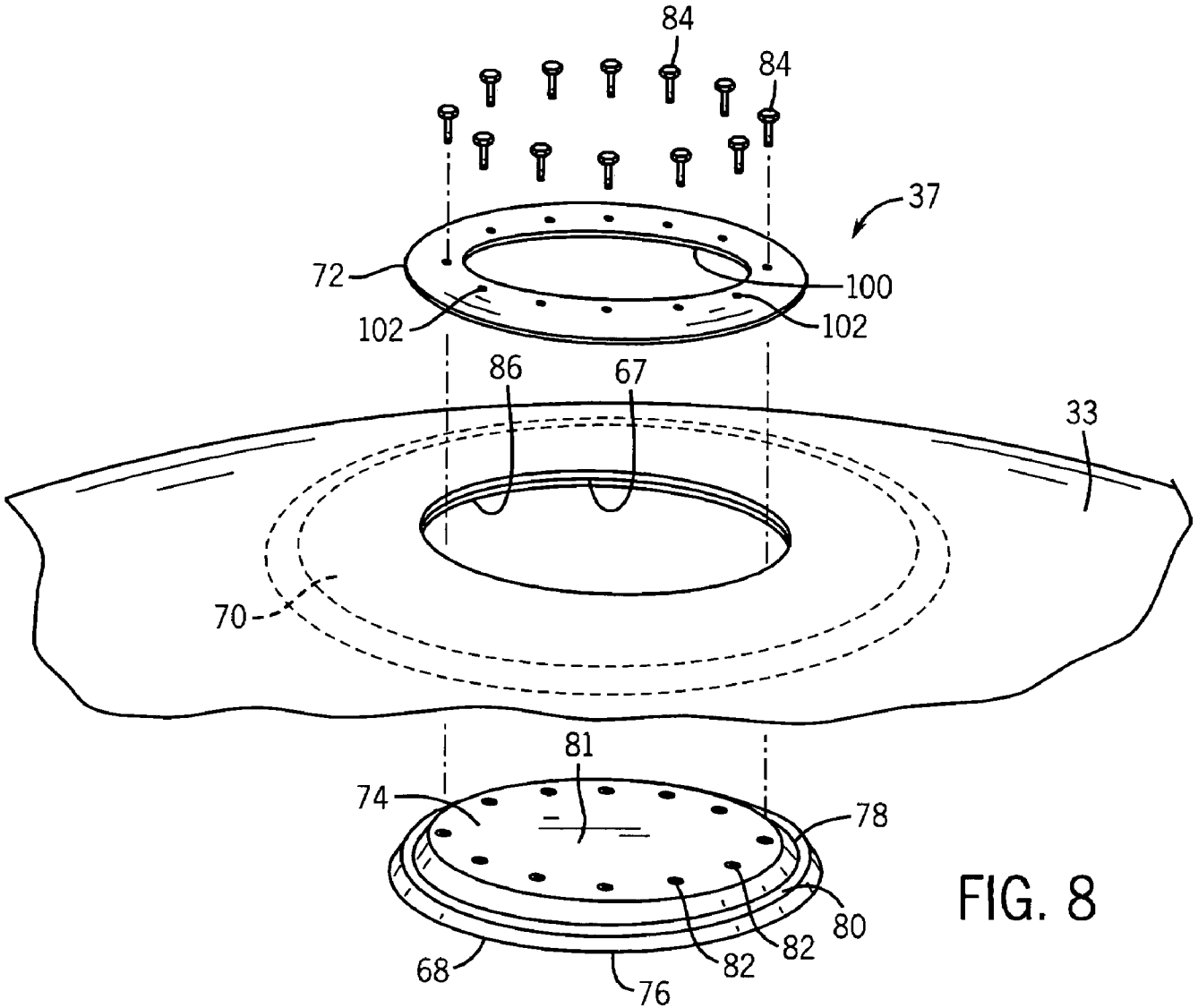
FIG. 8 is an exploded fragmentary perspective view of a hatch of the drum of FIG. 2 according to an example embodiment.
Figure 9:
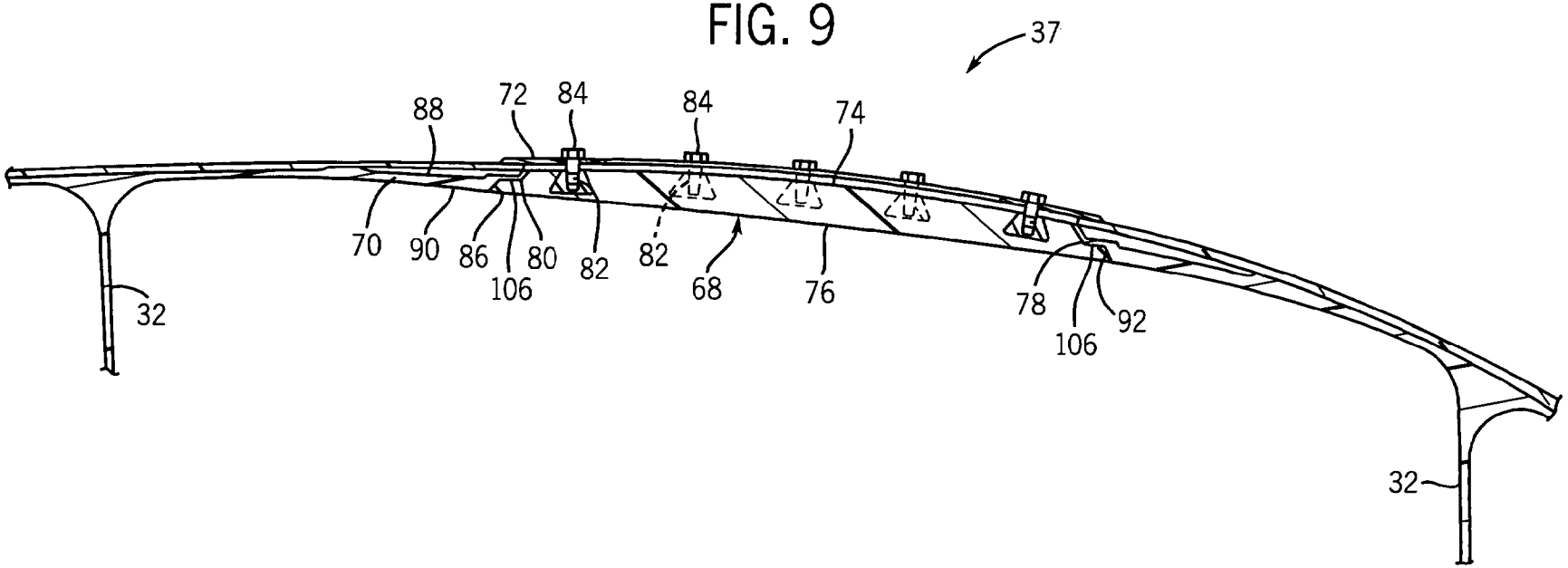
FIG. 9 is a sectional view of the hatch of the drum of FIG. 2.

Referring now to FIGS. 8 and 9, a hatch cover assembly 37 is shown according to one exemplary embodiment. Hatch cover assembly 37 includes a hatch cover 68 and a plate 72 and is intended to close and seal an opening or aperture 67 that is provided in barrel 33. According to one embodiment, opening 67 is generally oval-shaped, having a major axis of approximately 19.5 inches and a minor axis of approximately 15.5 inches. According to other alternative embodiments, the opening may have any one of a variety of different shapes and have a variety of different sizes. According to one exemplary embodiment, opening 67 has a size that is sufficient to allow a person to pass through the opening to gain access to the inside of barrel 33. The opening 67 may size to allow the concrete with barrel 33 to drain out through the opening 67. Hatch cover 68 (e.g., cover, door, closure, plate, etc.) is a generally circular or oval-shaped flat panel that includes an outer surface 74 and an inner surface 76. For purposes of describing the hatch cover assemblies, references to an "inner" or "inside" surface refer to the surface that is closest to or that faces the inside of drum 6, while references to an "outer" or "outside" surface refer to the surface that is closest to or faces the outside of drum 6. A recess 78 that extends into outer surface 74 of hatch cover 68 for approximately half the thickness of hatch cover 68 is provided on the outer periphery of hatch cover 68. Recess 78 has the effect of creating a flange or shoulder 80, which extends around the periphery of hatch cover 68 proximate inner surface 76, and a raised region 81, which extends from the center of hatch cover 68, each having a thickness equal to approximately half the thickness of hatch cover 68. Hatch cover 68 also includes coupling members (e.g., receiving members, fasteners, inserts, etc.) shown as threaded nuts 82 that are embedded into outer surface 74 of raised region 81. Nuts 82 are arranged in a pattern such that when the coupling members (e.g. posts, beams, pins, etc.), shown as bolts or studs 84, are coupled to nuts 82, bolts 84 extend through plate 72 and through opening 67.

Plate 72 (e.g., panel, cover, bolt plate, retaining ring, etc.) is a generally circular or oval-shaped disc that has an outside periphery that extends beyond (or overlaps) the periphery of opening 67 in drum 6. Plate 72 includes a plurality of apertures 102 that are configured to allow bolts 84 to pass through plate 72 and couple to nuts 82 in hatch cover 68. According to an exemplary embodiment, plate 72 includes an opening 100 that extends through the center of plate 72. According to an alternative embodiment, the plate may not include opening 100, but rather may be a substantially solid disc.

According to an exemplary embodiment, a panel 70 that substantially surrounds opening 67 is incorporated into drum 6. Panel 70 (e.g., plate, surround, support panel, etc.) is a generally circular or oval-shaped panel that is intended to reinforce and structurally support drum 6 in the areas surrounding opening 67. Panel 70 has an outer periphery that extends beyond (or overlaps) the outer periphery of hatch cover 68 as well as an opening 86 that is configured to receive hatch cover 68. Panel 70 includes an outer surface 88 and an inner surface 90. An annular recess 92, provided around opening 86 on inner surface 90, is configured to receive shoulder 80 of hatch cover 68. The depth of recess 92 (i.e., the distance the recess extends into panel 70) is approximately equal to the thickness of shoulder 80, which allows inner surface 76 of hatch cover 68 to be substantially flush with inner surface 90 of panel 70. By making inner surface 76 flush with the inside surface of inner drum layer 34, the inner surface of inner drum layer 34 remains generally smooth, which helps to avoid the build up of aggregate that tends to occur where there are abrupt changes in the inner surface of a drum.

According to an exemplary embodiment, panel 70 is made separately from sections 41 and 43 of inner drum layer 34 and is incorporated into inner drum layer 34 during the assembly of drum 6. According to one exemplary embodiment, panel 70 is incorporated into inner drum layer 34 by removing a section of inner drum layer 34 and replacing it with panel 70. By incorporating panel 70 into inner drum layer 34 in this manner, a seam is formed between panel 70 and inner drum layer 34. To minimize excessive wear in this seam area, the seam is filled with a filler material in much the same way that the seams between sections 41 and 43 are filled with a filler material. According to an alternative embodiment, one or more ramps may be provided on one or both sides of the seam to help direct concrete away from the seam. Preferably, panel 70 is inserted or incorporated into inner drum layer 34 before outer drum layer 36 is applied. If this is done, the outer drum layer 36 will initially cover opening 86 in panel 70. This area of outer drum layer 36 is then cut out to provide an opening 67 in drum 6 that provides access to the interior of drum 6.

To help maintain a consistent, smooth appearance and surface on both the inside and outside of drum 6, the panel may include various bevels and/or tapers on one or more of the different surfaces of the panel. Such bevels or tapers are preferably angled such that they follow the contour of the corresponding surfaces of the drum when outer drum layer 36 is applied over panel 70. According to another alternative embodiment, the entire outer surface and/or inner surface of the panel may be contoured such that the panel follows the general shape of the drum.

To cover and seal opening 67 provided in drum 6, hatch cover 68, panel 70, and plate 72 are arranged such that outer surface 88 of panel 70 is proximate the inner surface of outer drum layer 36, hatch cover 68 is placed within panel 70 with raised region 81 extending through opening 86 in panel 70, and plate 72 is placed on the outside surface of barrel 33 with bolts 84 extending though apertures 102 of plate 72 into nuts 82 in hatch cover 68. As bolts 84 are tightened, hatch cover 68 is pulled toward plate 72. As hatch cover 68 is pulled toward plate 72, hatch cover 68 presses against panel 70. When bolts 84 are fully tightened, hatch cover 68 is pressed against panel 70 with enough force to seal opening 67 in barrel 33. At the same time, plate 72 is pressed against the outside surface of drum 6. Essentially, hatch cover assembly 37 closes and seals opening 67 by "sandwiching" or clamping barrel 33 between hatch cover 68 and plate 72. By utilizing this clamping or sandwiching action, hatch cover assembly 37 avoids the need to drill holes in barrel 33, which, if not properly reinforced, may create stress concentrations in barrel 33 that may lead to failure.

To further improve the sealing ability of hatch cover assembly 37, a seal 106 (e.g., gasket, o-ring, grommet, etc.) is optionally provided between hatch cover 68 and panel 70. According to alternative embodiments, the seal may be made from a any one or more of a variety of different materials, including rubbers, silicone based materials, polymers, elastomers, etc. According to other alternative embodiments, the seal made be applied or incorporated in the hatch cover assembly in a solid form or in a paste or liquid form.

According to an exemplary embodiment, each of hatch cover 68, panel 70, and plate 72 are made from the same fiber reinforced composite that is used in the construction of outer drum layer 36. The inner surface 76 of hatch cover 68 and inner surface 90 of panel 70 are coated with the same material from which inner drum layer 34 is made, preferably polyurethane. This helps to provide inner surface 76 and inner surface 90 with the wear resistant properties possessed by other areas of inner drum layer 34.

According to an exemplary embodiment, raised region 81 of hatch cover 68 extends through opening 86 such that the outer surface of raised region 81 is substantially flush with the outer surface of barrel 33. According to an alternative embodiment, the hatch cover may not include the raised region, but rather the hatch cover may be a substantially flat panel. According to other alternative embodiments, either or both of the inner and outer surfaces of the panel and the hatch cover may be flat or may contoured to the correspond to the shape of the drum. According to other alternative embodiments, the hatch, panel, and plate may be made from a variety of other suitable materials. According to still other alternative embodiments, the hatch, panel, and/or plate may be partially or completely coated with the material from which inner drum layer 34 is made or with any one of a variety of different materials.

According to other various alternative embodiments, different methods, techniques, and coupling members may be used to couple hatch cover 68 to plate 72. For example, bolts or studs may be coupled to the coupling member embedded in the hatch cover such that the studs extend through the panel and the plate and nuts are screwed onto the portion of the stud that extends beyond the plate. Alternatively, coupling members may be embedded in the plate rather than in the hatch. Moreover, the hatch cover may include tapped holes, rather than embedded nuts, into which a bolt or a stud may be screwed. According to still other alternative embodiments, various levers, snapping devices, wedges, cams, and/or other mechanical or electrical devices may be used to couple the hatch cover and the plate.

According to still other alternative embodiments, that hatch, panel, and plate may take different shapes, sizes and configurations. For example, various portions of the hatch, panel and/or plate may be angled, beveled, recessed, etc. or may include various raises regions, protrusions, shoulders, etc. to facilitate the coupling or mating of the hatch, panel and/or plate. Moreover, different portions of the hatch, panel, and plate may be different sizes and shapes to account for changes in the thicknesses of the inner or outer drum layer, the location of the opening in the barrel, the particular use of the drum, and a plurality of other factors.

According to another alternative embodiment, panel 70 may be excluded from the drum. Rather, the hatch cover and plate may press against the one or more of the inner drum layer and the outer drum layer when the hatch cover is coupled to the plate. Moreover, one or both of the inner drum layer and the outer drum layer may include various recesses, tapers, shoulders, extensions, configurations, etc. that are intended to receive cooperating structures provided on the hatch cover and/or plate.

Figure 10:
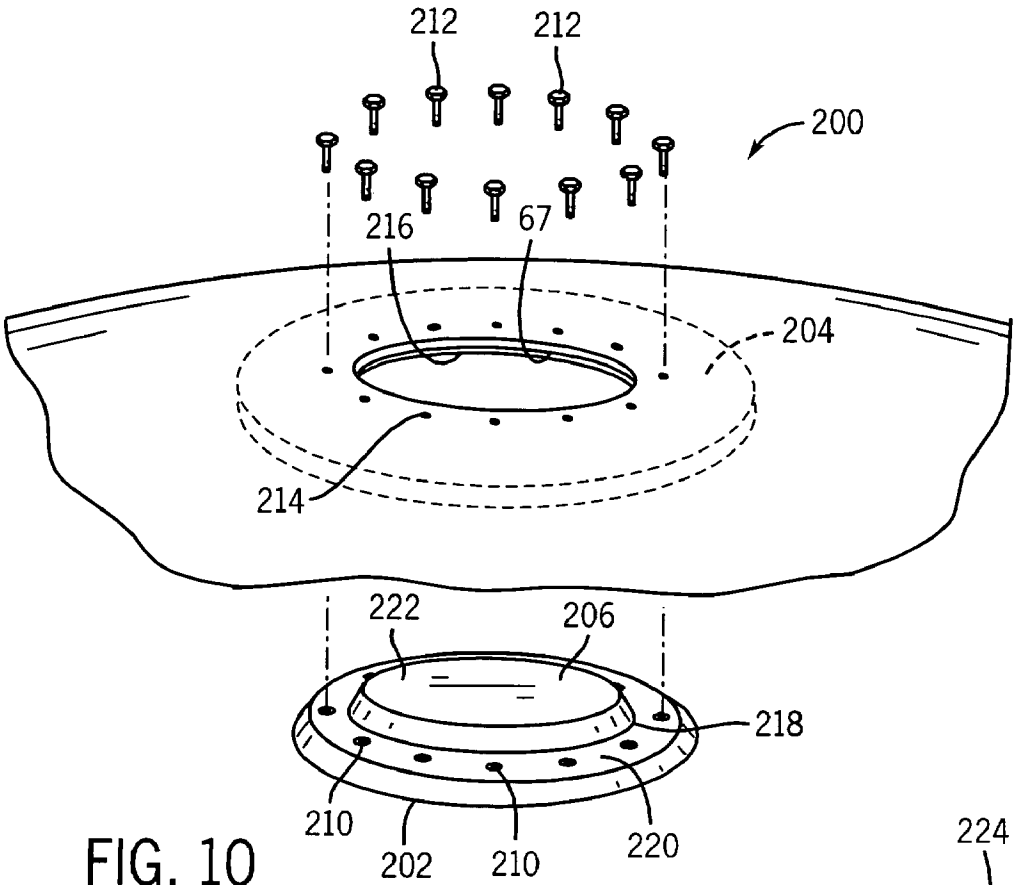
FIG. 10 is an exploded perspective view of another embodiment of a hatch of the drum of FIG. 2.
Figure 11:
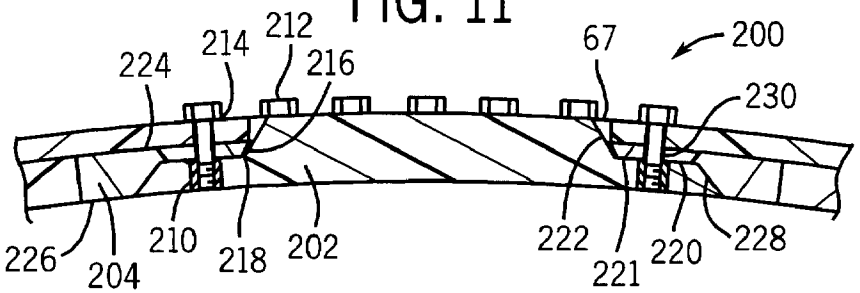
FIG. 11 is a fragmentary sectional view of the hatch of the drum of FIG. 10 according to an example embodiment.

Referring now to FIGS. 10 and 11, a hatch cover assembly 200 is shown according to another exemplary embodiment. Hatch cover assembly 200 includes a hatch cover 202 and a panel 204. Hatch cover 202 (e.g., door, closure, plate, etc.) is a generally circular or oval-shaped flat panel that includes an outer surface 206 and an inner surface 208. A recess 218 that extends into outer surface 206 of hatch cover 202 for approximately half the thickness of hatch cover 202 is provided on the outer periphery of hatch cover 202. Recess 218 has the effect of creating a shoulder 220, which extends around the periphery of hatch cover 202 proximate inner surface 208, and a raised region 222, which extends from the center of hatch cover 202, each having a thickness equal to approximately half the thickness of hatch cover 202. Hatch cover 202 also includes coupling members (e.g., receiving members, fasteners, inserts, etc.), shown as threaded nuts 210, that are embedded into the outer surface of recess 218 in a generally circular or oval pattern. The pattern of nuts 210 is such that bolts or studs 212 screwed into nuts 210 extend through openings 214 in drum 6 (rather than through the drum opening 67).

Panel 204 (e.g., plate, surround, support panel, etc.) is a generally circular or oval-shaped panel that is intended to reinforce and structurally support drum 6 in the areas surrounding opening 67. Panel 204 has an outer periphery that extends beyond (or overlaps) the outer periphery of hatch cover 202 as well as an opening 216 that is configured to receive hatch cover 202. Panel 204 includes an outer surface 224 and an inner surface 226. An annular recess 228, provided around opening 216 on inner surface 226, is configured to receive shoulder 220 of hatch cover 202. The depth of recess 228 (i.e., the distance the recess extends into panel 70) is approximately equal to the thickness of shoulder 220, which allows inner surface 208 of hatch cover 202 to be substantially flush with inner surface 226 of panel 204. A plurality of holes 230 that are configured to receive bolts 212 extend through panel 204. Holes 230 are arranged in a pattern that corresponds to that pattern in which nuts 210 are arranged.

When hatch cover assembly 200 is in the closed position, outer surface 206 of hatch cover 202 presses against inner surface 226 of panel 204. In this position, shoulder 220 of hatch cover 202 is received within recess 228, and raised region 222 of hatch cover 202 extends into opening 216 in panel 204. Accordingly, inside surface 208 of hatch cover 202 is substantially flush with the inside surface of inner drum layer 34. By making inside surface 208 flush with the inside surface of inner drum layer 34, the inner surface remains generally smooth, which helps to avoid the build up of aggregate that tends to occur where there are abrupt changes in the inner surface of a drum.

To further improve the sealing ability of hatch cover assembly 200, a seal 221 (e.g., gasket, o-ring, grommet, etc.) is optionally provided between hatch cover 202 and panel 204. According to alternative embodiments, the seal may be made from a any one or more of a variety of different materials, including rubbers, silicone based materials, polymers, elastomers, etc. According to other alternative embodiments, the seal made be applied or incorporated in the hatch cover assembly in a solid form or in a paste or liquid form.

According to an exemplary embodiment, raised region 222 of hatch cover 202 extends through opening 216 such that the outer surface of raised region 222 is substantially flush with the outer surface of barrel 33. According to an alternative embodiment, the hatch cover may not include the raised region, but rather the hatch cover may be a substantially flat panel. According to other alternative embodiments, either or both of the inner and outer surfaces of the panel and the hatch cover may be flat or may contoured to the correspond to the shape of the drum.

According to various alternative embodiments, that hatch cover and the panel may take different shapes, sizes and configurations. For example, various portions of the hatch cover and/or panel may be angled, beveled, recessed, etc. or may include various raises regions, protrusions, shoulders, etc. to facilitate the coupling or mating of the hatch cover with the panel. Moreover, different portions of the hatch cover and panel may be different sizes and shapes to account for changes in the thicknesses of the inner or outer drum layer, the location of the opening in the drum, the particular use of the drum, and a plurality of other factors. According to other alternative embodiments, the hatch cover assembly may also include a bolt plate (or washer) on the outside of the drum that includes apertures through which the bolts can pass and be coupled to the hatch.

Panel 204 is incorporated into inner drum layer 34 in much the same way that panel 70 is incorporated into inner drum layer 34. A section of inner drum layer 34 is removed and replaced by panel 204, and the seam formed between panel 204 and inner drum layer 34 is filled with a filler material as described above with respect to hatch cover assembly 37. Preferably, panel 204 is inserted or incorporated into inner drum layer 34 before outer drum layer 36 is applied. If this is done, outer drum layer 36 will initially cover opening 216 in panel 204. This area of outer drum layer 36 is then cut out to provide an opening 67 in barrel 33 that provides access to the interior of drum 6. According to an alternative embodiment, ramps may be provided on one or both sides of the seam around panel 204 in the same fashion they are provided on one or both sides of the seams between the two sections of the inner drum layer.

In hatch cover assembly 200, panel 204 is intended to serve as a reinforcing or structural member that enables the area of barrel 33 around opening 67 to withstand the forces that are applied to barrel 33 by the various components of hatch cover assembly 200 and the concrete within the drum. The inclusion of holes 214 in barrel 33 tends to weaken barrel 33 in the area around hatch cover assembly 200. Accordingly, structural support for barrel 33 is beneficial in that it helps barrel 33 withstand forces that it may not be able to withstand in the absence of panel 204.

According to an exemplary embodiment, panel 204 and hatch cover 202 are made from a fiber reinforced composite material. To provide panel 204 and hatch cover 202 with the wear resistant characteristics that are possessed by the other internal structures of drum 6, panel 204 and hatch cover 202 are preferably coated, in whole or in part, with an elastomer such as polyurethane.

Figure 14:
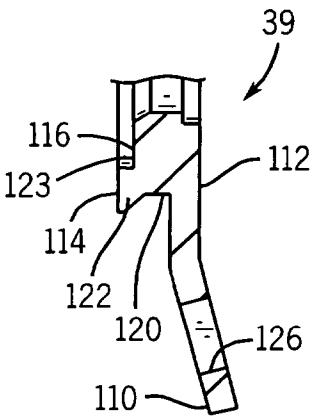
FIG. 14 is a sectional view of the drive ring of FIG. 13 taken along line 14-14 according to an example embodiment.
Figure 13:
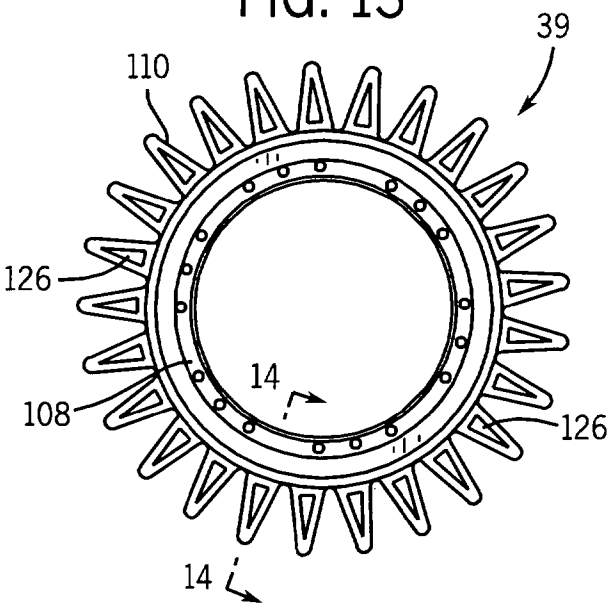
FIG. 13 is a front elevational view of the drive ring of FIG. 12 according to an example embodiment.
Figure 12:
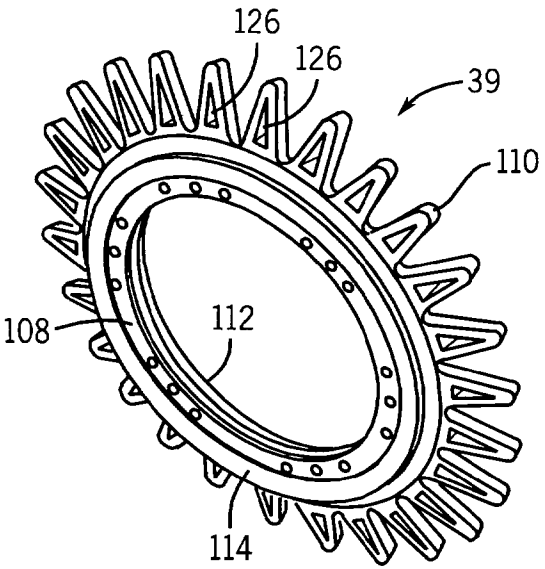
FIG. 12 is a perspective of a drive ring of the drum of FIG. 2 according to an example embodiment.

Referring now to FIGS. 12-14, drive ring 39 (e.g. sprocket, spider, daisy, etc.) includes a hub 108 and extensions 110. Hub 108 (e.g., mount, coupling, etc.) is a generally cylindrical member that is designed to couple to mixing drum drivetrain 18. Hub 108 includes an inner side 112 (i.e., the side of hub 108 that faces drum 6) and an outer side 114 (i.e., the side of hub 108 that faces away from drum 6). A circular recess 116, which helps to facilitate the secure coupling of drivetrain 18 to hub 108, is provided in outer side 114. The diameter of recess 116 is such that the circumference of recess 116 lies approximately half way between an inner diameter 118 and an outer diameter 120 of hub 108. Apertures 121, which allow hub 108 to be bolted or otherwise coupled to mixing drum drivetrain 18, are spaced circumferentially around a base 123 of recess 116. A flange 122, which also facilitates the coupling of hub 108 to mixing drum drivetrain 18, extends radially outwardly from outer diameter 120 proximate outer side 114 of hub 108. An inner side 124 of flange 122 is tapered and gradually extends from the circumference of flange 122 toward outer diameter 120 of hub 108 as flange 122 extends toward drum 6. According to various alternative embodiments, the hub may be configured to be coupled to any one of a variety of different mixing drum drivetrains. Accordingly, the hub may take any one of a variety of different shapes and include any one or more of a variety of different features or elements that allow the hub to be coupled to a particular drive drivetrain.

A plurality of extensions 110 (e.g., fingers, projections, spikes, tangs, etc.) are spaced apart along the circumference of hub 108 and generally extend from hub 108 proximate inner side 112. According to an exemplary embodiment, each extension is a generally rectangular or triangular member that extends both radially outwardly from hub 108 and away from inner side 112 of hub 108. According to another exemplary embodiment, each extension is a generally triangular member. Each extension 110 includes an aperture or opening 126 that extends through the center of each extension 110 and that has the same general shape as the outline or periphery of extension 110.

Figure 15:
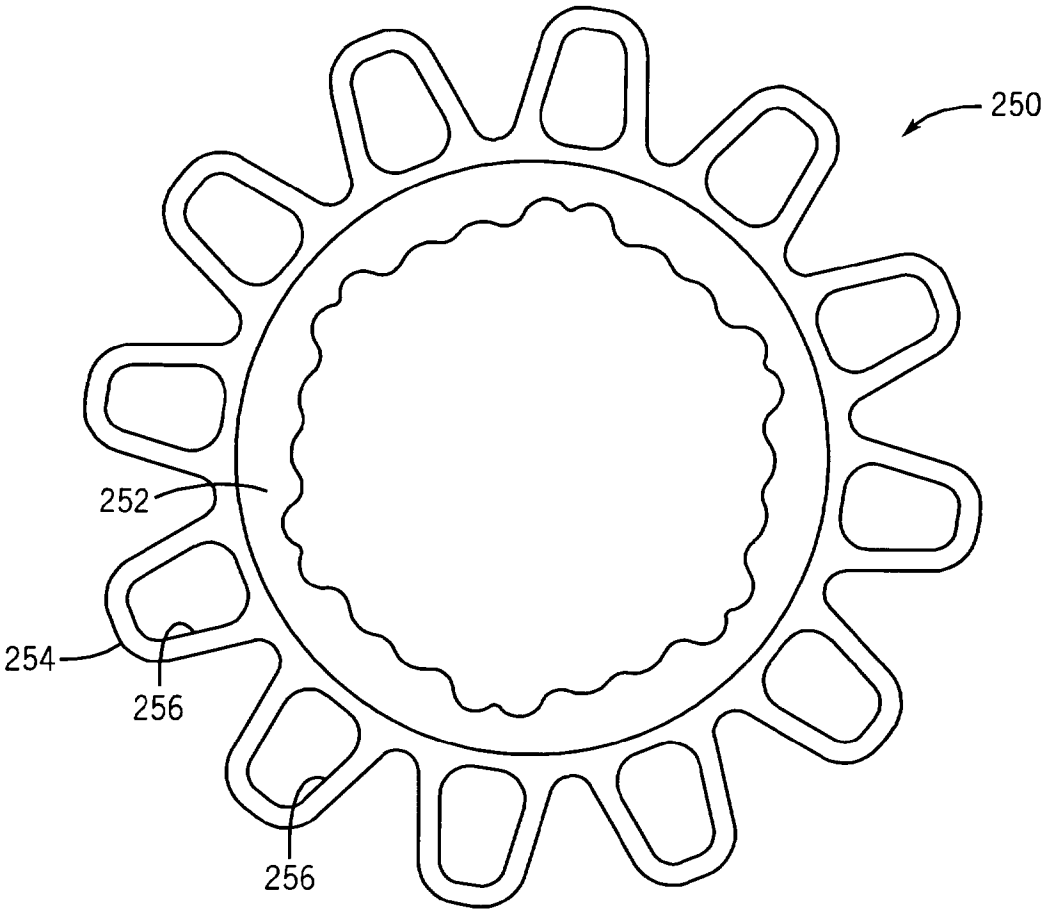
FIG. 15 is a front perspective view of another embodiment of the drive ring of the drum of FIG. 2 according to an example embodiment.

FIG. 15 illustrates another exemplary embodiment of a drive ring. Drive ring 250 (e.g. sprocket, spider, daisy, etc.) includes a hub 252 and extensions 254. Hub 252 (e.g., mount, coupling, etc.) is a generally cylindrical member that is designed to couple to mixing drum drivetrain 18. Hub 252 is substantially similar to hub 108 described above in relation to drive ring 39, except extra material between the holes is removed to reduce the weight of drive ring 250. According to various alternative embodiments, the hub may be configured to be coupled to any one of a variety of different mixing drum drivetrains. Accordingly, the hub may take any one of a variety of different shapes and include any one or more of a variety of different features or elements that allow the hub to be coupled to a particular drive drivetrain.

A plurality of extensions 254 (e.g., fingers, projections, spikes, tangs, etc.) are spaced apart along the circumference of hub 252 and generally extend from hub 252. According to an exemplary embodiment, each extension is a generally rectangular member that extends both radially outwardly from hub 252 and away from hub 252. Each extension 254 includes an aperture or opening 256 that extends through the center of each extension 254 and that has the same general shape as the outline or periphery of extension 254.

According to various exemplary and alternative embodiments, the drive ring may include no extensions or it may include up to or over 20 extensions. According to one exemplary embodiment, the drive ring includes 12 extensions. Generally, the smaller the extensions, the more extensions may be provided around the hub. According to other exemplary embodiments, the space S between the extensions ranges from 0 to 6 inches. According to other exemplary embodiments the aperture provided in the extensions is of size that is sufficient to allow resin used in the construction of outer drum layer 36 to infiltrate or enter the aperture. According still other alternative or exemplary embodiments, the apertures may be larger or smaller, which as the effect of reducing or increasing the weight of the drive ring. According to still other exemplary embodiments, the extensions angle away from the side of the hub that is closest to the barrel by approximately 15 degrees. According to one exemplary embodiment, the extensions angle such that the contour with the shape of the drum.

According to an exemplary embodiment, the drive rings are cast from an off-tempered ductile iron, preferably an 805506 ductile iron. According to various alternative embodiments, the drive ring may be made from one or more of a variety of different materials using one or more of a variety of different methods. For example, the hub could be made separately from the extensions, and then the two could be welded, bolted, or otherwise coupled together to form the drive ring. According to other alternative embodiments, dimensions (such as the thicknesses, widths, heights, etc.) of the hub and extensions may be varied depending on the specific application in which the drive ring will be used.

The drive rings are preferably coupled or attached to larger end 30 of drum 6 while the outer drum layer 36 is being applied over inner drum layer 34. This allows the fibers that are wrapped around inner drum layer 34 to be wrapped or woven between and/or around each of the extensions, or even through the apertures. This also allows the resin used to make outer drum layer 36 to enter and fill the spaces between the extensions as well as the spaces provided by the apertures in the extensions. The infiltration of the resin and the weaving of the fibers around and through the extensions helps to strengthen the connection of the drive ring to drum 6 and helps to distribute the loads that are transferred between drum 6 and the drive ring. Because the extensions are incorporated into drum 6, the extensions extend from the drive ring at an angle that allows the extensions to fit within the contour of drum 6.

According to various alternative embodiments, the apertures and/or the extensions may be any one of a variety of different shapes, such as rectangular, trapezoidal, oval, circular, etc. Moreover, any one or more of the apertures and/or the extensions may be shaped differently than one or more of the other apertures and/or extensions. According to other alternative embodiments, the extensions may be solid and not include apertures. According to still other alternative embodiments, the angle or orientation of the extensions with respect to the drive ring may be varied to accommodate different drum shapes and configurations.

Referring back to FIGS. 1-3, drum 6 also includes roller ring 35. Roller ring 35 is a circular member that fits around the outside of drum 6 at a location approximately one-third of the way from the smaller end of drum 6 toward larger end 30. A surface 128 provided on the outer diameter of roller ring 35 is configured to serve as the surface against which rollers 130 (illustrated in FIG. 1) (which support a portion of the weight of drum 6 along with drivetrain 18 and drive ring 39) ride as drum 6 rotates. According to an exemplary embodiment, roller ring 35 is made from a polymer material. According to various alternative embodiments, the roller ring is made from one or more of a variety of different materials, including but not limited to metals, plastics, elastomers, ceramics, composites, etc.

The spiral configuration of each projection 32 provides a screw- or auger-like action when drum 6 is rotated. Depending on the direction of rotation of drum 6, projections 32 will either force the concrete within drum 6 out of opening 28, or projections 32 will force the concrete toward larger end 30, which tends to mix the concrete. Accordingly, while the concrete is being transported within drum 6, mixing drum drivetrain 18 applies a torque to drum 6 that causes drum 6 to rotate about its longitudinal axis 31 in a first direction that results in the mixing of the concrete. Once a truck 110 is positioned beneath opening 28, tilt actuator 22 tilts drum 6 and mixing drum drive 8 applies a torque to drum 6 that causes drum 6 to rotate about its longitudinal axis in a direction opposite the first direction, to discharge the concrete out of opening 28. As drum 6 rotates and the concrete within drum 6 contacts and applies a force to projections 32, tapered base portion 42 and support member 48 help to prevent projection 32 from failing or bending over under the load of the concrete. Moreover, as the concrete is moved within drum 6, it will travel over the seams between sections 41 and 43 of inner drum wall 34. Ramps 40 help to reduce the wear in the areas around the seams by directing the concrete away from the seam. Hatch cover assemblies 37 and 200 cover opening 67 provided within barrel 33 and help to seal the opening and prevent the concrete from escaping through opening 67. Hatch cover assemblies 37 and 200 also couple to barrel 33 in such a way that does not significantly weaken barrel 33 in the areas around opening 67. The design of drive rings 18 and 250 allows either one of them to be coupled to barrel 33 and withstand the various forces applied to drive rings 18 and 250 and barrel 33. The apertures in drive rings 18 and 250 also help to reduce weight.

The composite and plastic construction of the drum helps effective mixing allow the inner surfaces of the drum, and helps to minimize any heat that may be retained within drum. The materials and processes used to construct the drum also allow the drum to be manufactured with minimal labor, to maintain a relatively light weight, to withstand the normal loads, and to be more resistant to wear than conventional metal mixing drums. Moreover, the drive rings and hatch cover assemblies effectively perform the functions of similar devices used in metal mixing drums and at the same time are compatible with a composite or plastic drum. The drive rings and hatch cover assemblies may also be produced cheaper and lighter than the metal mixing drum counterparts.

Referring once again to FIG. 3, drum 6 is substantially formed from two major layers 34, 36 of material that extend across an axial midpoint of drum 6 and particularly extend from end 28 to end 30. Layers 34 and 36 generally serve to provide the main structure of drum 6. Although not illustrated, additional non-structural layers or coatings may additionally be added. For example, relatively thin paint, decals, coatings or other non-structural layers may be further applied to the exterior of layer 36. For purposes of this disclosure, the use of the term "exterior" with reference to barrel 30 or drum 6 generally refers to the exterior of layer 36 despite the potential presence of additional non-structural layers over top of layer 36, such as decals, paint, coatings or other non-structural layers. Because layers 34 and 36 extend across an axial midpoint of drum 6 and nominally extend from end 40 to end 42, drum 6 has improved structural strength along the axial length between main portion 44 and snout portion 46. In addition, because layers 34 and 36 continuously and integrally extend as unitary bodies from end 40 to end 42, drum 6 lacks seams or joints where sections would otherwise be bolted or fastened together. As a result, drum 6 lacks interior corners where concrete or aggregate may collect, making cleaning easier. At the same time, exterior of drum 6 also lacks surface discontinuities, outwardly projecting flanges (other than roller ring 36), or other abrupt surface contours where concrete and aggregate may collect, further simplifying cleaning of drum 6.

Layer 34 generally comprises a polymer impregnated or infused with a slip agent. For purposes of this disclosure, the term "slip agent" refers to any substance, whether in solid or liquid form that when mixed with a polymer reduces the coefficient of friction of the polymer along its surface as compared to the same polymer without the substance. In one particular embodiment, the slip agent has a surface energy less than the surface tension of a Portland Cement low slump concrete. In another embodiment, the slip agent has a surface energy of less than about 20 dynes per centimeter. In one embodiment, the slip agent is configured so as to not substantially migrate within the polymer. As a result, the slip agent does not migrate to a boundary between layers 34 and 36 which could present lamination issues. In one embodiment, the slip agent is a polydecene. In another embodiment, the slip agent is a polyalpha olefin. In another embodiment, the slip agent is polytetraflourethylene. In other embodiments, other slip agents may be employed.

In one embodiment, the polymer into which the slip agent is impregnated includes polyurethane. According to one exemplary embodiment, the slip agent impregnated into the polyurethane is polytetraflourethylene. The polytetraflourethylene comprises a powder. Because the polytetraflourethylene is a solid, it is held firmly in place within the polyurethane matrix. The polytetraflourethylene is at least 2% by weight of the impregnated polyurethane. In particular, it has been found that impregnating the polyurethane with at least 2% by weight of the polytetraflourethylene reduces the adhesion of concrete and other aggregate material to interior surfaces 56 of drum 6. In the exemplary embodiment, the polytetraflourethylene has a percentage by weight of less than 5% of the impregnated polyurethane. As a result, the impregnated polytetraflourethylene does not significantly impact or weaken the polyurethane. In particular embodiments where physical strength of the impregnated polymer are not required, the polytetraflourethylene may have a greater percentage by weight of the impregnated polyurethane.

According to one exemplary embodiment, the polytetraflourethylene comprises a Teflon powder sold under the mark Zonyl MP-1600 by Dupont, the specifications of which are provided in Appendix C. In other embodiments, other polytetraflourethylenes with other particle sizes or in other forms may be employed. According to one embodiment, the polytetraflourethylene powder is dispersed into a polyol using high sheer mixing with a Cowles blade. In one embodiment, the polytetraflourethylene powder is mixed with the polyol prior to the addition of a prepolymer and a plasticizer, Benzoflex. This process results in polytetraflourethylene powder being finely disbursed throughout the polymer (polyurethane) matrix. Because the polytetraflourethylene powder is mixed with the polyol prior to addition of the prepolymer or Benzoflex, the mixture has a lower surface tension which reduces the amount of surface air on the polytetraflourethylene powder and reduces air bubbles formed by coalescence of the air during the polyol/prepolymer reaction. Reducing the number of air bubbles in the impregnated polymer increased the strength of the impregnated polymer (impregnated polyurethane).

significantly reduces the coefficient of friction of the polyurethane at levels which do not substantially degrade the physical strength or structural qualities of the polyurethane. In addition, the polyalpha olefin fluid does not entrain air during its impregnation or addition to the polymer. The chart below indicates physical qualities of the impregnated polyurethane (provided by ERA polymers) when impregnated with 1%, 2% and 5% by weight polytetraflourethylene powder (Zonyl MP-1600N) and the impregnated polyurethane when impregnated with a polyalpha olefin fluid (SYNTON oil 100) at levels of 1%, 2% and 5% by weight.

| | | | PTFE (MP-1600) | | | Synton Oil 100 | | |
|---|---|---|---|---|---|---|---|---|
| Test | Units | Control | 1% | 2% | 5% | 1% | 2% | 5% |
| Hardness Shore A | Shore A | 90.2 | 89.6 | 88.4 | 88.3 | 89.1 | 89 | 89.5 |
| Tensile Strength | MPa | 17.8 | 16.8 | 16.6 | 10.8 | 17.1 | 15.7 | 16.7 |
| Modulus 100% | MPa | 9.7 | 9.4 | 8.7 | 8.3 | 9.1 | 9 | 8.6 |
| Modulus 200% | MPa | 11.1 | 11.1 | 10.4 | 9.4 | 10.9 | 10.6 | 10.3 |
| Modulus 300% | MPa | 12.7 | 12.8 | 12.1 | 10.3 | 12.5 | 12.2 | 12.2 |
| Elongation at Break | % | 546 | 485 | 507 | 338 | 506 | 482 | 491 |
| Tear Strength | kN/m | 75.2 | 72.1 | 68.4 | 65.6 | 72.2 | 70.8 | 69.4 |
| Peel Strength (90 deg/neat) | ppl | 137 | 69 | 62 | 63 | 116 | 113 | 121 |
| Peel Strength (90 deg/split) | ppl | 98 | 67 | 50 | 57 | 74 | 80 | 83 |
| Peel Strength (180 deg/Crtn) | ppl | 92.5 | 91.7 | 88.9 | 88.3 | | | |
| Peel Strength (180 deg/Dex) | N | 178 | 274 | 276 | 135 | 71 | 93 | 102 |
| Seam Strength | N | 1210 | 2273 | 2433 | 2055 | 1579 | 2197 | 2175 |
| NBS Abrasion (Avg. 2 sets) | index | 1061 | 1363 | 1419 | 1196 | 1865 | 1878 | 1569 |
| DIN Abrasion (Avg. 2 sets) | index | 323 | 332 | 311 | 325 | 415 | 386 | 353 |
| COF (Static) | | 0.65 | 0.42 | 0.37 | 0.36 | 0.4 | 0.29 | 0.29 |
| C OF (Dynamic) | | 0.72 | 0.45 | 0.38 | 0.34 | 0.38 | 0.35 | 0.5 |
| Texus Flox | cycles (7 days/14 days | <500/1360 | <500/4430 | <500/2170 | <500/500 | <500/4770 | <500/3730 | <500/3500 |
| Concrete Adhesion | Qualitative Adhesion | Firmly | Firmly | Lightly | None | Lightly | None | None |

According to another embodiment, the slip agent comprises a polyalpha olefin sold under the mark SYNTON oil by Crompton Corporation, the specifications of which are included in Appendix D. In particular, SYNTON oil is a polydecene. In the embodiments in which the polyalpha olefin fluid is impregnated into polyurethane and has a percentage by weight of between 2 and 5 percent, the coefficient of friction of interior surfaces 56 will be reduced by approximately 55%. Due to its highly branched structure, migration of the polyalpha olefin fluid within the polyurethane matrix is relatively slow. As a result, the fluid does not significantly migrate towards layer 36. In one particular embodiment, the polyalpha olefin fluid has a percent by weight of at least 1% of the impregnated polymer (polyurethane). As a result, concrete adherence to surface 56 is light. In another embodiment; the polyalpha olefin fluid has a percent by weight of at least 2% of the impregnated polymer, resulting in the impregnated polymer having imperceptible concrete adherence to surface 56. In one embodiment, the polyalpha olefin fluid has a percent by weight no greater than 5% of the impregnated polymer. As a result, the physical properties of the polyurethane are not substantially affected. In particular applications, the polyalpha olefin fluid may have a greater percent by weight of the impregnated polymer where required physical properties of the polymer are not as stringent. Polyalpha olefin fluid Overall, because layer 34 is formed from a polymer impregnated with a slip agent, layer 34 which forms interior surfaces 56 of drum 6 has a lower coefficient of friction and adheres less to concrete or other aggregate being mixed within drum 6. During mixing of concrete and aggregate, surfaces 56 are normally abraded, forming small grooves and scratches in which concrete forms a mechanical lock and hardens. However, due to its lower coefficient of friction, surface 56 impedes the collection of concrete or other aggregate within such scratches. Moreover, because the slip agent is impregnated or at least partially disbursed throughout the polymer to form layer 34, layer 34 is sufficiently durable so as not wear at an excessive rate as compared to a layer consisting solely of a slip agent such as polytetraflourethylene. In addition, the structural strength of other physical qualities of the polymer are maintained and used in particular embodiments. Although particular examples have been provided describing the use of polytetraflourethylene or a polyalpha olefin fluid impregnated into a polymer such as polyurethane, other polymers and other slip agents may alternatively be employed at various relative concentrations depending upon the required physical qualities of the impregnated polymer. Although layer 34 is described as comprising a polymer impregnated with a slip agent to reduce the coefficient of friction and adherence of the resulting material, layer 34 may alternatively be formed by a slip agent, such as polytetraflourethylene, impregnated with a strength or durability agent, wherein the strength or durability agent is in a substance which, when added to the slip agent, increases the strength or durability of the slip agent.

Figure 2:
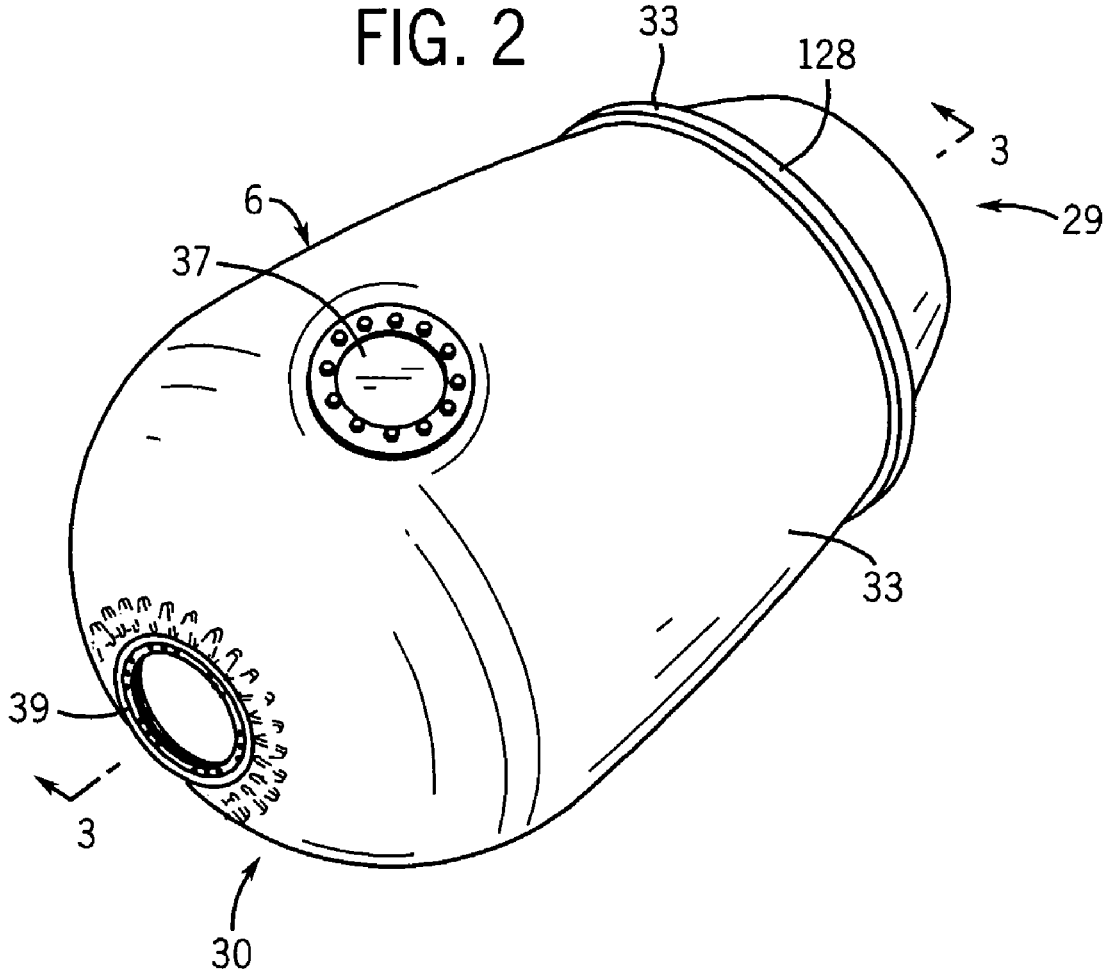
FIG. 2 is a top perspective view of a transit mixer drum of the concrete batch plant of FIG. 1 according to an example embodiment.

In the particular embodiment illustrated, layer 34 extends along interior surface 58 or barrel 30 as well as exterior surfaces 60 of projections 32. As shown by FIG. 4, in one particular embodiment, layer 34 forms an entire thickness of projection 32 at a radial mid-portion of projection 32. As shown by FIGS. 2 and 3, layer 34, which provides interior surface 56 of drum 6, is provided by two elongate archimedean or helical sections 80, 82. Each section 80, 82 provides an interior surface 58 of barrel 30 and provides a projection 32. Sections 80 and 82 are spirally wrapped or screwed to one another with their edges extending adjacent or to close proximity with one another.

After sections 80 and 82 are positioned adjacent to one another, such sections 80 and 82 each extend substantially from end 40 to end 42, layer 36 is formed in a continuous integral fashion from end 40 to end 42 over sections 80 and 82 and across the seams between sections 80 and 82. In one particular embodiment, layer 36 is formed from fiberglass windings which are coated with resin and wrapped or wound over and around layer 34 and sections 80 and 82. In one embodiment, the resin is Hetron 942, available from Ashland Chemical, in Dublin, Ohio, and the fibers are fiberglass, preferably 2400 Tex E glass (approximately 206 yards per pound). The angles at which the fibers are wound about layer 34 at the major axis (location at which barrel 30 as a greatest diameter) is approximately 10.5 degrees relative to the central axis of barrel 30. During the winding process, the resin coated fiber windings are wrapped generally from one end of the drum to the other. The ribbon of the windings is wrapped around the drum such that there is approximately 50% overlap between each pass of the ribbon. The wrapping of the fibers or windings from end to end provide drum 6 with structural support to withstand various forces in various directions. A more detailed discussion of sections 80, 82, projections 32 and the fiberglass windings of layer 36 is provided in copending International Patent Application Serial No. PCT/US03/25656 entitled Mixing Drum, the full disclosure of which is hereby incorporated by reference and which is attached as Appendix A and copending International Patent Application Serial No. PCT/AU03/00664 filed on May 31, 2003 by Anthony Khouri entitled Vehicle Mounted Concrete Mixing Drum and Method of Manufacture Thereof, wherein the entirety of International Patent Application Serial No. PCT/AU03/00664 is hereby incorporated by reference and is attached as Appendix E. Layer 34 of the present application is similar to the interior polymer layer forming the interior surface of the drum and projections described in copending International Patent Application Serial No. PCT/US03/25656 and copending International Patent Application Serial No. PCT/AU03/00664 except that such layer 34 is impregnated with a slip agent.

Figure 18:
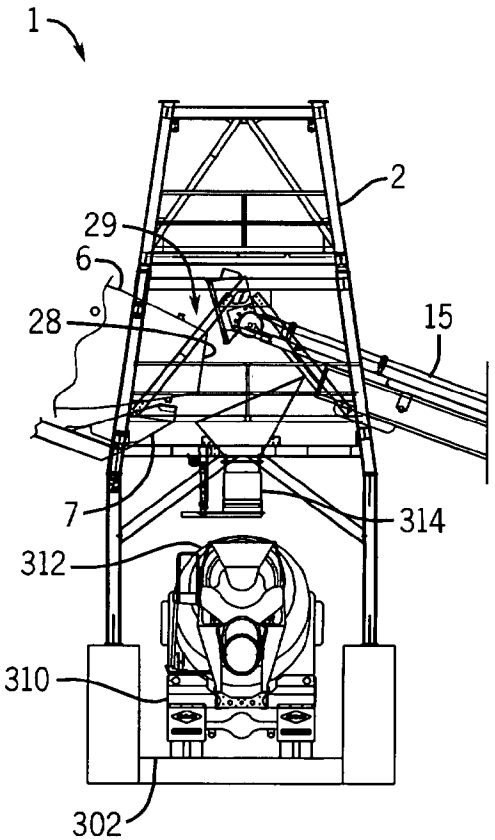
FIG. 18 is a fragmentary elevational view of the concrete batch plant of FIG. 1 illustrating the transit drum in an unloading position according to an example embodiment.
Figure 17:
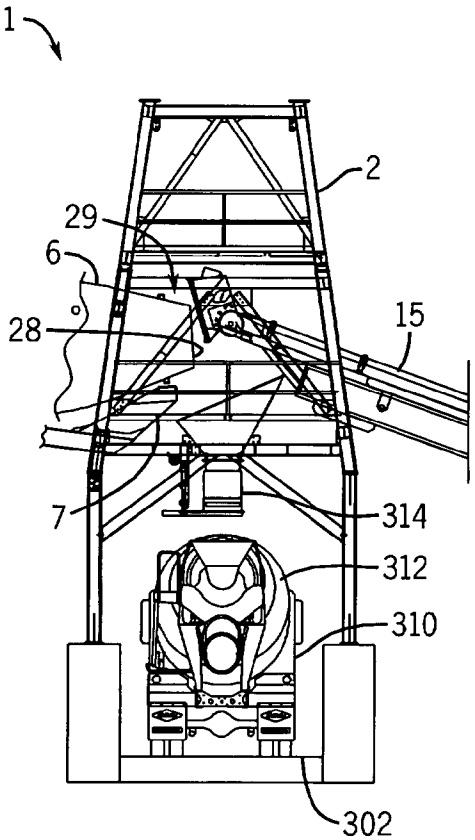
FIG. 17 is a fragmentary elevational view of the concrete batch plant of FIG. 1 illustrating the transit drum in a mixing position according to an example embodiment.
Figure 16:
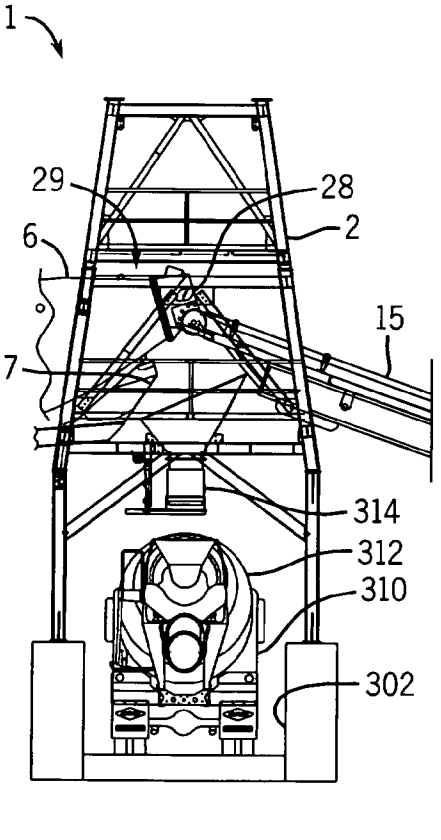
FIG. 16 is a fragmentary elevational view of the concrete batch plant of FIG. 1 illustrating the transit drum in a load position according to an example embodiment.

Tilt actuator 7 comprises a device configured to pivot drum 6 about pivot axis 300 between a loading position, a mixing position and a discharging position shown in FIGS. 16-18, respectively. In one embodiment, actuator 7 may comprise one or more hydraulic cylinders pivotally mounted between from 2 and drum 6. In another embodiment, other forms of actuators may be used to pivot drum 6.

Drum drive 8 comprises a device configured to rotatably drive drum 6 about its longitudinal axis in a first mixing direction and a second discharging direction. In one embodiment, drive 8 includes transit mixer hydrostatics and a mixer reduction drive to rotate drum 6. in other embodiments, other rotary actuators may be employed to drive drum 6.

FIGS. 16-18 illustrate operation of concrete batch plant 1. As shown by FIG. 16, tilt actuator 7 pivots or tilts drum 6 to a loading position in which opening 28 is situated to receive cement from device 30 and to receive aggregate from transport mechanism 15. Premeasured cement and aggregate are loaded into drum 6. In addition, liquid, such as water, is poured into drum 6. During such loading, drum drive 8 may rotate drum 6 about its axis to facilitate loading by moving ingredients towards end 30 and to initiate mixing. In other embodiments, drum 6 may be pivoted to a first position to receive cement and a second position to receive the aggregate.

As shown by FIG. 17, once the ingredients for the concrete or other mixture being prepared have been deposited into drum 6, tilt actuator 7 pivots drum 6 to lower end 29. Drum drive 8 rotates drum 6 in a direction such that the internal blades of drum 6 mix the ingredients. Because drum 6 is lowered (about 17 degrees in the example shown), a greater volume of drum 6 is used to mix the ingredients. In other embodiments, the degree by which drum 6 is tilted may vary.

As shown by FIG. 18, to discharge the mixed ingredients, tilt actuator 7 pivots drum 6 to further lower opening 28 such that the mixed concrete flows under the force of gravity out of drum 6. To increase the rate at which concrete is discharged, drum drive 8 may also rotate drum 6 in a reverse direction such that the internal blades move the concrete towards opening 28.

In the particular example shown, drum 6 is supported above a vehicle passageway 302 (shown as a ramp), enabling the concrete to be directly discharged with the assistance of gravity into a vehicle 310. Although vehicle 310 is illustrated as a transit mixer truck having a transit mixer drum 312, vehicle 310 may alternatively comprise of vehicles such as dump trucks and the like. In the particular example shown, discharged concrete is funneled into drum 312 by chute 314. In other embodiments, chute 314 may be omitted. In other embodiments, drum 6 may alternatively be pivoted to discharge concrete onto a conveyor or other transport mechanism which loads the concrete into a vehicle. Although drum 6 is illustrated as being lowered an additional 12.5 degrees from the mixing position to discharge concrete, drum 6 may alternatively be lowered by other degrees as well.

Overall, concrete batch plant 1 offers several advantages. First, because plant 1 utilizes a transit mixer drum rather than a conventional batch plant mixer drum, the weight of plant 1 is substantially reduced. In those embodiments where batch plant 1 is to be portable, this reduced weight greatly facilitates transport. The weight of batch plant 1 is even more greatly reduced when drum 6 comprises a non-metallic drum such as shown and described above with respect to the example in FIGS. 2-15.

Second, because drum 6 comprises a transit mixer drum having helical or archimedean internal blades and because drum 6 is also configured to be tilted, loading, mixing and discharging are enhanced. In particular, drum 6 may be driven while being tilted in the loading position to quickly move ingredients towards end 30. Drum 6 may also be tilted to an intermediate mixing position, enabling a maximum volume of drum 6 to be utilized to mix the ingredients. Lastly, drum 6 may be driven while being tilted in the discharge position to quickly discharge the ingredients into an underlying vehicle or onto an underlying conveyor.

Although not specifically illustrated, drum 6 may also be tilted upward beyond the loading position to a non-interfering position, enabling the ingredients to be directly loaded via gravity into vehicle 310, bypassing drum 6. This ability may be extremely beneficial during periods in which drum 6 is out of commission such as when drum 6 or drive 8 are being repaired. As a result, utilization of plant 1 is not ended.

Third, because drum 6 and drive 8 are configured to be utilized on a transit mixer truck, repair and replacement of either drum 6 or drive 8 is easier. In many circumstances, a plant operator is more likely to have parts or repair materials readily available in case of a breakdown of drum 6 or drive 8. The cost of such a repair is also less expensive due to the volume of transit mixer trucks manufactured as compared to typical plant mixer drums.

Fourth, in those embodiments in which drum 6 comprises a non-metallic drum such as illustrated in FIGS. 2-15, cleaning of drum 6 is easier. Such cleaning is especially enhanced in those embodiments in which the inner layer of drum 6 includes a slip agent. Although the slip agent is illustrated as being impregnated into the polymeric layer, the slip agent may alternatively be provided as a layer upon the polymeric layer.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A concrete batch plant comprising:

a frame;

a cement supply;

an aggregate supply;

a transit mixer drum, the transit mixer drum configured for use both in a stationary batch plant and as a mixer drum on a transit mixer truck, the drum having an open end and a closed end, the drum being pivotally coupled to the frame for movement between a first position in which the open end is positioned to receive cement from the cement supply and to receive aggregate from the aggregate supply and a second position in which the open end is positioned to discharge mixed cement and aggregate, wherein the drum includes an interior surface formed by a plurality of complementary molded helical polymeric sections joined along a helical seam.

2. The plant of claim 1, wherein the frame elevates the transit mixer such that the drum discharges mixed cement and aggregate directly into a vehicle using gravity.

3. The plant of claim 1, wherein the drum is pivotable to a third position distinct from the first position and the second position for mixing.

4. The plant of claim 1, wherein the drum includes an interior surface having a continuous blade extending in an archimedean spiral.

5. The plant of claim 1, wherein the drum is pear-shaped.

6. The plant of claim 1, wherein the drum includes a polymeric interior layer.

7. The plant of claim 6, wherein the drum includes a fiber reinforced material layer about the polymeric layer.

8. The drum of claim 6, wherein the polymeric layer is impregnated with a slip agent.

9. The drum of claim 6, wherein the polymeric layer forms a circumferential interior surface of the drum and a blade integrally projecting from the circumferential interior surface.

10. The plant of claim 1, wherein the cement supply includes a silo.

11. The plant of claim 1, wherein the aggregate supply includes a silo.

12. The plant of claim 1, wherein the cement supply includes an apportioning device configured to apportion cement to the mixer drum.

13. The plant of claim 12, wherein the apportioning device is configured to weigh cement.

14. The plant of claim 1, wherein the aggregate supply includes an apportioning device configured to apportion aggregate to the mixer drum.

15. The plant of claim 14, wherein the apportioning device is configured to weigh aggregate.

16. The plant of claim 1, wherein at least one of the aggregate supply and the cement supply includes a conveyor.

17. The plant of claim 1 including a liquid supply.

18. The plant of claim 17, wherein the open end of the drum is positioned to receive liquid from the liquid supply when the drum is in the first position.

19. The plant of claim 17 including an apportioning device configured to apportion the liquid being supplied to the drum.

20. A concrete batch plant comprising:

a frame;

a cement supply;

an aggregate supply;

a transit mixer drum, the transit mixer drum including an open end, a closed end, and an interior surface formed from a plurality of complementary molded helical polymeric sections joined along a helical seam, the drum being pivotally coupled to the frame for movement between a first position in which the open end is positioned to receive cement from the cement supply and to receive aggregate from the aggregate supply and a second position in which the open end is positioned to discharge mixed cement and aggregate.

21. The plant of claim 20, wherein the interior surface of the drum includes a continuous blade extending in an archimedean spiral.

22. The plant of claim 20, wherein the blade is integrally molded with the interior surface of the drum.

* * * * *